US007677192B2

(12) United States Patent
Scism et al.

(10) Patent No.: US 7,677,192 B2
(45) Date of Patent: Mar. 16, 2010

(54) SLOT-V HULL SYSTEM

(76) Inventors: Randy Scism, 165 Enterprise Dr., Wentzville, MO (US) 63385; George Scism, 2164 Yandell Cove Rd., Kirbyville, MO (US) 65679

( * ) Notice: Subject to any disclaimer, the term of this patent is extended or adjusted under 35 U.S.C. 154(b) by 0 days.

(21) Appl. No.: 11/408,524

(22) Filed: Apr. 20, 2006

(65) Prior Publication Data

US 2007/0245944 A1 Oct. 25, 2007

(51) Int. Cl.
*B63B 1/04* (2006.01)
*B63B 1/18* (2006.01)
*B63B 1/32* (2006.01)

(52) U.S. Cl. ..... 114/288; 114/291

(58) Field of Classification Search ..... 114/271, 114/284, 288–291, 61.32, 61.33, 67 A; D12/313, D12/314
See application file for complete search history.

(56) References Cited

U.S. PATENT DOCUMENTS

| | | | | | |
|---|---|---|---|---|---|
| 971,029 | A | * | 9/1910 | Fauber | 114/291 |
| 1,024,682 | A | * | 4/1912 | Fauber | 114/291 |
| 1,050,517 | A | * | 1/1913 | Chase | 114/290 |
| D79,534 | S | * | 10/1929 | Smith | D12/313 |
| 2,423,860 | A | * | 7/1947 | Patten | 114/291 |
| 3,316,874 | A | | 5/1967 | Canazzi | |
| 3,469,557 | A | * | 9/1969 | Wollard | 440/69 |
| 3,604,385 | A | | 9/1971 | Reider | |
| 3,661,109 | A | * | 5/1972 | Weiland | 114/291 |
| 3,761,980 | A | * | 10/1973 | Silverstein | 441/68 |
| 4,231,314 | A | * | 11/1980 | Peters | 114/291 |
| 4,348,195 | A | | 9/1982 | Lantz | |
| 4,574,724 | A | | 3/1986 | Stolper | |
| 4,702,188 | A | * | 10/1987 | Harilainen | 114/61.32 |
| 4,708,085 | A | | 11/1987 | Blee | |
| 4,813,365 | A | * | 3/1989 | Lindstrom et al. | 114/271 |
| 4,903,626 | A | * | 2/1990 | Haines | 114/291 |
| 4,915,668 | A | * | 4/1990 | Hardy | 440/69 |
| 4,977,845 | A | * | 12/1990 | Rundquist | 114/289 |
| 5,038,696 | A | | 8/1991 | Athanasiou et al. | |
| 5,427,048 | A | * | 6/1995 | Takeuchi | 114/288 |
| 5,452,675 | A | | 9/1995 | Devin | |
| 5,452,676 | A | * | 9/1995 | Fiore | 114/291 |
| D383,109 | S | * | 9/1997 | Livingston | D12/314 |
| 5,718,184 | A | * | 2/1998 | Holland | 114/271 |
| D406,809 | S | * | 3/1999 | Mannerfelt | D12/314 |
| D407,682 | S | * | 4/1999 | Mannerfelt | D12/314 |
| 6,125,781 | A | * | 10/2000 | White | 114/288 |
| 6,138,602 | A | | 10/2000 | Cary | |

(Continued)

FOREIGN PATENT DOCUMENTS

AU 585713 B 6/1989

*Primary Examiner*—Ajay Vasudeva
(74) *Attorney, Agent, or Firm*—Klotzer Patents; Daniel Klotzer

(57) ABSTRACT

The present invention comprises systems and methods of utilizing hull arrangements that combine aerodynamic and hydrodynamic effects to provide marine vessels with broader ranges of performance capabilities. The combination hull arrangements variously combine V-hulls, slot aspects, topographic features, and other hull characteristics that enable a vessel to retain the primary performance benefits of conventional V-hulls and achieve assorted improvements. Embodiments of the slot-V hull system employ specifically shaped hull characteristics to influence the manners in which water, air, and air/water spray mixtures interact with the vessel's hull. One principal operative effect can enable a vessel with the slot-V hull system to achieve a planing attitude more rapidly and efficiently than a standard V-hull.

60 Claims, 7 Drawing Sheets

U.S. PATENT DOCUMENTS

| | | | | |
|---|---|---|---|---|
| 6,213,824 | B1 | 4/2001 | Small | |
| 6,250,246 | B1 | 6/2001 | Hubley | |
| 6,293,218 | B1 * | 9/2001 | White | 114/288 |
| 6,406,341 | B1 | 6/2002 | Morejohn | |
| 6,425,341 | B1 | 7/2002 | Devin | |
| 6,575,106 | B1 | 6/2003 | Whitener | |
| 6,604,478 | B2 | 8/2003 | Barsumian | |
| 6,675,736 | B1 | 1/2004 | Schreiber et al. | |
| 6,837,176 | B1 | 1/2005 | Rogerson | |
| 6,925,953 | B1 * | 8/2005 | Batista et al. | 114/288 |

* cited by examiner

SLOT-V HULL SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to systems and methods of configuring marine vessel hulls with combination hull arrangements, and more specifically to systems and methods of configuring a hull with combination hull arrangements that utilize aerodynamic and hydrodynamic effects to provide broader ranges of performance benefits than are provided by uncombined hull arrangements.

2. Related Art

Marine vessels may encounter widely varying conditions and can be asked to perform well in a broad range of tasks. A broad variety of hull arrangements have been devised in order to provide performance benefits that are particularly well suited for certain tasks or conditions. While many of these individual hull arrangements are advantageous for accomplishing certain objectives they have been devised for, there often are also significant limitations in the range of situations in which they are capable of performing well. These limitations can be generally characterized in at least one of two ways. The first characterization is the type of function at which the vessel can perform well, and the second characterization is the type of conditions in which the vessel can operate well. Frequently, limitations characterized in one way are also capable of being characterized in the other way.

For marine vessels, designs intended to provide certain functional capabilities must also take into account both the conditions in which the vessel will normally operate, as well as the potential for the vessel to encounter less customary or even extreme conditions. Often, designs are primarily optimized for the normal operating conditions, while some provision, often limited, is made for the less common conditions. For example, a V-hull design provides capabilities of traversing waters with significant waves while lessening their jarring effects by virtue of its ability to "cut" through the waves. However, a V-hull is also susceptible to greater rolling, for example due to steering changes, and is less efficient when moving at high speeds across relatively calm waters than are flatter bottom hulls or catamarans which will normally plane more easily. By the same token, those hulls that plane most easily, and hence are more efficient for travel at higher speeds, are also more susceptible to being adversely affected by larger waves, and their uses can be limited by their difficulties in handling turbulent waters.

One approach to surmounting these limitations has been to develop hull designs that amalgamate aspects of disparate hull designs. Hulls which attempt to combine the virtues of both V-shapes and efficient planing bottom shapes are frequently compromises that may not perform either task optimally, but hope to at least avoid the worst performance problems of both. In some designs, hull step(s) are also utilized to attempt to facilitate easier planing. While some of these approaches have managed to avoid various performance deficits of certain single-shape hull designs, or expand the range of conditions in which a vessel can operate well, there remain substantial amounts of improvement in both performance gains and reductions in condition-based limitations that are desirable, but not yet available.

SUMMARY OF THE INVENTION

The present invention encompasses both systems and methods of arranging marine vessel hulls that blend a generally V-shaped fore hull portion with an aft hull portion that is capable of achieving a planing attitude more readily than a conventionally V-shaped hull. Hull arrangements of many embodiments of the present invention will incorporate what is termed herein a slot aspect that is comprised of at least one downwardly opening recess formed into the underside of portions of, or all of the vessel's hull. The slot aspect is frequently arrayed along the longitudinal axis of the marine vessel, and usually extends rearwardly to at least the vicinity of the vessel's transom. While the slot aspect, in various embodiments of the present invention, assumes differing transverse cross-sections and longitudinal lengths, in general it is of distinctly greater length than width or depth.

Several embodiments according to the present invention comprise marine vessel hull arrangements that also incorporate at least one topographic feature that facilitates ventilation of the underside of the hull. The topographic feature(s) provides a form of channeling action that is capable of aerodynamically influencing air from the atmosphere to access the region immediately below the hull portion, when the marine vessel is in forward motion at an appreciable rate of travel. Most often, the topographic feature will be disposed so as to facilitate ventilation of the region of the hull's underside that is in contact with the water when the vessel is either approaching or at planing speed. When a marine vessel approaches planing speed, it can experience a need for a substantial power input to transition from a displacing attitude to a planing attitude. This effect is particularly pronounced for step hulls that can create a lower pressure area in the space immediately aft of the step when accelerating, since the hull's partial lifting out of the water produces a void that water is induced to attempt to fill if the area is not ventilated, which thereby works against the hull's ability to transition to a planing attitude. The ventilating effect of the topographic feature is capable of at least partially mitigating this lowered-pressure effect between the hull's underside and the water surface that can result when a vessel's speed increases both in stepped and non-stepped hull arrangement embodiments according to the present invention. In those embodiments that include a slot aspect as well, the topographic feature influences air to specifically access the region of the slot aspect. In embodiments of the present invention that involve hull arrangements incorporating at least one step, the topographic feature(s) will generally influence air to access the region immediately trailing the step(s). Frequently, but not exclusively, the topographic features will be arranged in pairs, disposed symmetrically on opposite sides of the marine vessel's longitudinal axis.

The myriad benefits of the slot-V hull system include, but are not limited to:

a) Increased longitudinal stability due to the slot aspect providing an effect analogous to that of a keel fin or keel plate, but with neither the increased drag nor the greater draft of such a keel.

b) Reduction in roll caused by rough water or steering changes, due to the capability of utilizing a flatter bottom than is normally available for a vessel that also provides a V-hull's benefits.

c) Reduction in lateral sliding in turns, particularly at high speeds, again due to the slot aspect's providing of a keel-plate-like effect.

d) Reduction in drag induced by the component of the water displacement that is normal to the hull surface, due to the elimination of the further downward extension of the hull, in the region of the slot. This reduction in drag permits a higher maximum speed with the same propulsion power, or alternatively a similar maximum speed with less propulsion power than is normally available for a vessel that also provides a V-hull's benefits.

e) Reductions in the power output, fuel consumption, and time required for the vessel to reaching a planing attitude due to enhanced capabilities of ventilating selected regions of the hull's underside.

f) Provision of a more comfortable ride due to reduced lateral roll, and deceleration forces.

g) Reduction in overall vessel cost in comparison to a vessel of similar size and performance, due to construction cost being comparable to a similarly sized V-hull, while engine costs are reduced by the lesser demand in propulsion power and fuel consumption costs are reduced due to greater operating efficiency.

Embodiments of the present invention are well suited for a broad range of applications as well. Effectively any planing water craft design and/or construction that could utilize a conventional V-bottom hull is likely also capable of benefiting from the advantages provided by the slot-V hull system, advantages which are not available to a hull made from a conventional V-bottom design. Additionally, many vessels which would have not previously been constructed with any form of a V-bottom hull due to functional or environmental considerations, can now utilize the slot-V hull system to address those considerations and still take advantage of the benefits of a V-bottom hull. The slot-V hull system, due to a wide variety of design parameter flexibilities, is capable of being customized for optimal application across an extensive scope of situations. The design parameters that can be varied include, but are not limited to, slot aspect width, depth, length, and forward terminus disposition; manners of disposition and utilization of the topographic feature(s) for ventilation; incorporation of one of more steps in the hull bottom; methods of combining various numbers of the assorted parameters that are described individually or in combinations herein; as well as permutations of the constituents of these combinations.

While the range of vessels and means of employing the slot-V hull system is quite sizable, a representative vessel designed according to one embodiment of the present invention provides an illustrative example of an application of the slot-V hull system. Many factors can influence the design process for a hull arrangement when optimizing applications of the slot-V hull system. These factors may include parameters of the vessel under construction such as length, beam, depth, weight, power, dead rise angle, bow shape, hull composition, presence and aspects of chines, strakes, steps, as well as numerous other attributes. Further factors may also include anticipated operating environment aspects such as waves, swells, wakes, wind, altitude, water salinity, and many others; in addition to desired performance factors such as speed, ride quality, stability, handling, time-to-on-plane, acceleration, rough water capabilities, turn radius at speed, and several additional factors. For an exemplary vessel with the dimensions of length≈30 feet, beam≈8½ feet, hull depth≈4 feet, weight≈5000 lbs., dead rise angle≈24°, with strakes, with 2 steps, constructed of fiberglass, and having an engine capable of ≈500 hp power output; said exemplary vessel projected to operate in an environment with waves≈2-3 feet, swells≈2-3 feet, wakes≈2-3 feet, wind ranging from 0-40 mph, altitude ranging from 0-2000 feet, and fresh water operation; said vessel's desired performance including capabilities of 60-75 mph speed, acceleration from 0-60 mph in ≈15 seconds, good ride, excellent stability, excellent handling, and time-to-plane≈4 seconds; the application of the slot-V hull system would include a hull arranged with 2 steps, a slot aspect extending aftward from the first step through past the second step to the transom, two pairs of topographic features (each pair having one topographic feature each arrayed on opposite sides of the vessel and disposed so that each pair would facilitate ventilation of a different step), wherein the slot aspect would have the dimensions of width≈10-15% of the vessel's beam, length of ≈60-80% of the vessel's overall length, and depth (i.e. upward recess height) of ≈2-4% of the vessel's beam. Alternatively, an exemplary vessel could be similarly arranged except with only a single topographic feature that extends forward from the slot aspect along the vessel's longitudinal axis to a graduated initiation along the upward curve of the vessel's bow. In either case, it should be understood that these examples are only illustrative of two applications of embodiments of the present invention, and are not limiting of the number or variety of embodiments that fall within the scope of the slot-V hull system, nor are they limiting of the number or variety of possible applications of any of the embodiments of the slot-V hull system.

Other objects and features will be in part apparent and in part pointed out hereinafter.

DETAILED DESCRIPTION OF THE PREFERRED EMBODIMENTS

In the following description, identical numbers indicate identical elements. Where an element has been described in one Figure, and is unaltered in detail or relation in any other Figure, said element description applies to all Figures.

Figure 1:
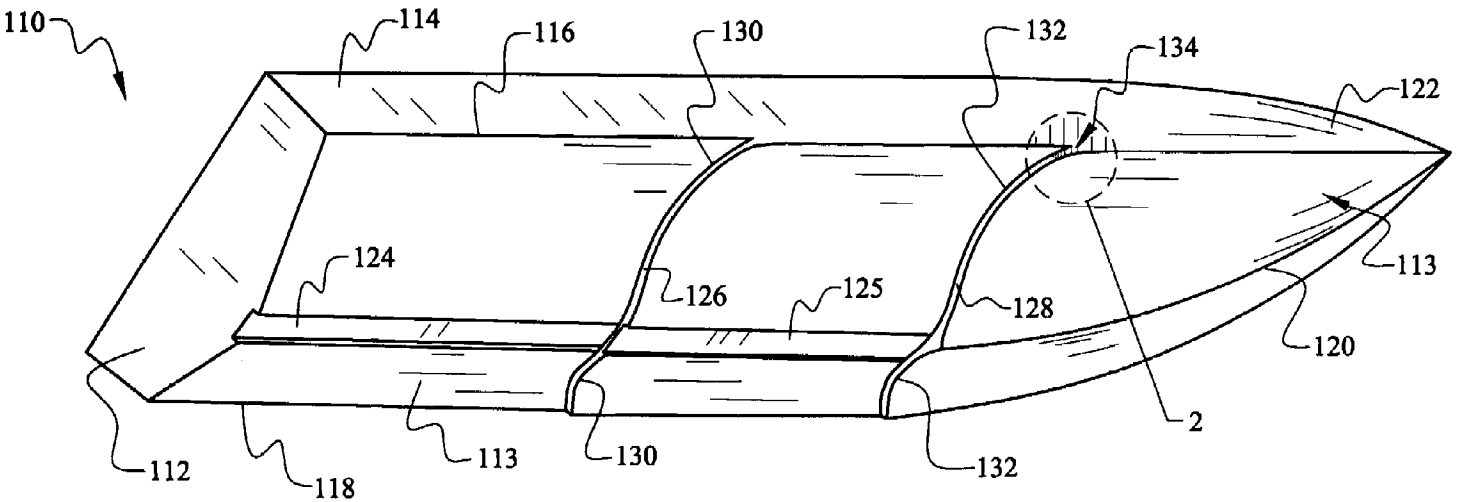
FIG. 1 depicts an upward and forward perspective view from a below, to the right side, and behind vantage point of a marine vessel hull arrangement according to a first embodiment of the present invention. In the present specification and claims, for purposes of consistency, the terms left and right are utilized in lieu of port and starboard, respectively, when referring to the sides of a marine vessel, and it should be understood that when these terms are utilized in reference to the relative side of a vessel, they refer to right and left as seen when facing the vessel from the rear in the direction of the vessel's forward motion, with the vessel in an upright orientation. In these circumstances then, the left side corresponds to port, and the right side corresponds to starboard.

In FIG. 1, a first embodiment of the present invention shows the underside of a first hull arrangement 110 for a marine vessel. The first hull arrangement 110 includes a transom 112, a first hull bottom surface 113, a right vessel side 114 and a left vessel side (not shown), a right chine 116 and a left chine 118, a keel 120, and a bow 122. the first hull arrangement 110 further includes an aft slot aspect section 124, a fore slot aspect section 125, an aft step 126, and a fore step 128. A pair of aft topographic features 130 and a pair of fore topographic features 132 are arranged to flow into the aft step 126 and the fore step 128, respectively. The right and left aft topographic features 130, as depicted, are essentially mirror images of each other and are disposed symmetrically about a longitudinal plane of symmetry of the vessel, as are the right and left fore topographic features 132. Each of the pairs of aft topographic features 130 and fore topographic features 132 flow into the aft step 126 and fore step 128, respectively. In the FIG. 1 depiction of the hull arrangement 110, the transitions from the aft topographic features 130 and the fore topographic features 132 to the aft step 126 and the fore step 128, respectively, are continuous without distinct demarcations, but alternative embodiments with distinct and/or discontinuous transitions are also within the scope of the present invention. In operation, when the vessel is moving forward at speed through the atmosphere, air flows along the side 114 of the vessel and first encounters the fore topographic feature 132 at its forward upper end 134 in the region of dashed circle 2. While the transition from the vessel side 114 to the forward upper end 134 can be continuous or discontinuous, one particularly useful form of transition is a continuous, graduated change in surface angle, from the nearly flat (in the vicinity of the forward upper end 134) surface of the side 114 to the curving surface of the fore topographic feature 132. This transition from the vessel side 114 to the forward upper end 134 can range from very gradual to distinctly abrupt, depending on the requirements and design choices involved in the vessel's construction. Due to well known properties of laminar flows (defined as "a non-turbulent flow of a viscous fluid in layers near a boundary", and in this case an air flow immediately adjacent the boat surface is substantially a laminar flow), as well as other aerodynamic effects, the air flowing along the side 114 will tend to continue following along the surface and thereby tend to begin to flow along the fore topographic feature 132. At least some portion of the airflow that is thus induced to begin following along the fore topographic feature 132 will be influenced to continue along the course of the fore topographic feature 132 and access and ventilate both the region immediately aft of the fore step 128 plus the region of the fore slot aspect section 125. While the first hull arrangement 110 as shown in FIG. 1 includes two steps, two separate slots, and two pairs of topographic features, hull arrangements with differing numbers of steps (from none through to more than two), with differing numbers and/or configurations of slots (again from none through to more than two, as well as a single slot aspect spanning more than one step), and differing numbers of topographic features (once again from none through to varying numbers, as well as unsymmetrical arrangements of topographic features) are all also within the scope of the present invention.

Figure 2:
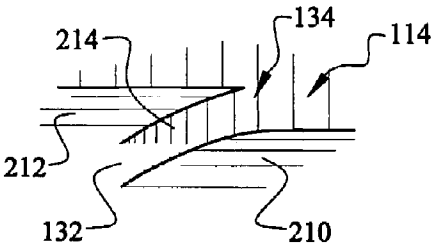
FIG. 2 depicts an expanded detail view of the area bounded by the dashed circle 2 of FIG. 1, showing the circumscribed portion of a first topographic feature arrangement.

In FIG. 2, the region circumscribed by dashed circle 2 of FIG. 1 is shown in greater detail so as to more fully illustrate the interrelationships of the surfaces that comprise the exterior of the vessel hull in that region. The aft topographic feature 130 and the fore topographic feature 132 are seen to be configured with a first set of contours, wherein the first set of contours involves a discontinuous step upward in the surface of the hull bottom, from a pre-topographic feature surface 210 to a post-topographic feature surface 212. The fore topographic feature 132 transitions from the pre-topographic feature surface 210 to the post-topographic feature surface 212 with a guide surface 214 that is substantially at right angles to both the pre-topographic feature surface 210 and the post-topographic feature surface 212. As shown in FIG. 2, the transition at the upper forward end 134 between the right vessel side 114 and the guide surface 214 is graduated. The degree of this gradation shown in FIG. 2 is slightly limited, and is depicted to illustrate that a range of types of transitions are within the scope of the present invention, said range extending from a fully graduated continuous transition through to a sharply discontinuous transition. Though in many cases a fully graduated transition may provide benefits, in other cases a limited degree of gradation may be beneficial due to potential gains in hull integrity, reduced fabrication costs, and other factors.

Figure 4:
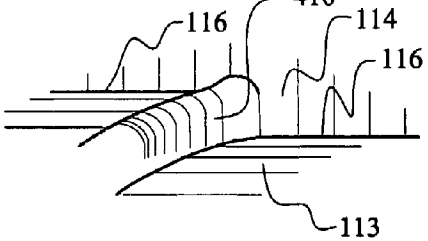
FIG. 4 depicts an expanded detail view of the area bounded by the dashed circle 2 of FIG. 1, showing the circumscribed portion of the second topographic feature arrangement.
Figure 3:
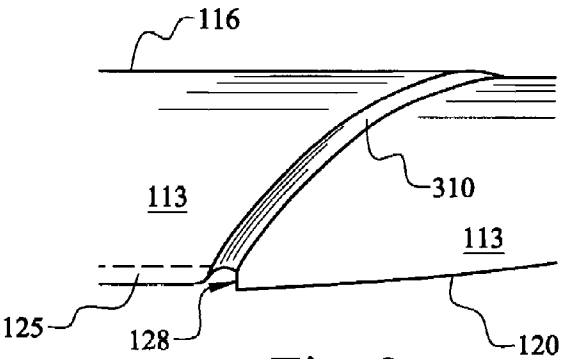
FIG. 3 depicts an expanded detail side-view of a second topographic feature arrangement, showing the extent of said second topographic feature from the area of dashed circle 2 in FIG. 1 down to the bottom of the vessel hull.

In FIG. 3 is shown a second topographic feature 310 that is arranged with a second set of contours. The view of FIG. 3 is from a side perspective, showing the portion of the vessel hull that extends from the chine 116 down to the keel 120 and the fore slot aspect 125. The spatial disposition of the second topographic feature configuration 310 is similar to that of the topographic features 130 and 132. The primary difference between the topographic features 130 and 132 and the second topographic feature 310 are due to the variations between the first and second sets of contours. In FIG. 4 is shown a third topographic feature 410 that is arranged with a third set of contours. The view of FIG. 4 is substantially the same as the view of FIG. 2. The spatial disposition of the third topographic feature configuration 410 is also similar to that of the topographic features 130 and 132. The primary difference between the topographic features 130 and 132, the second topographic feature 310, and the third topographic feature 410 are due to the variations between the first, second, and third sets of contours. These differences are described in more detail in the descriptions of FIGS. 5, 6, & 7 following.

Figure 5:
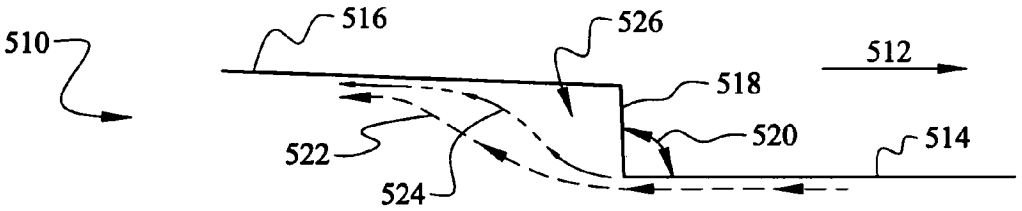
FIG. 5 depicts a schematic detail cross-section view of a first step arrangement.
Figure 6:
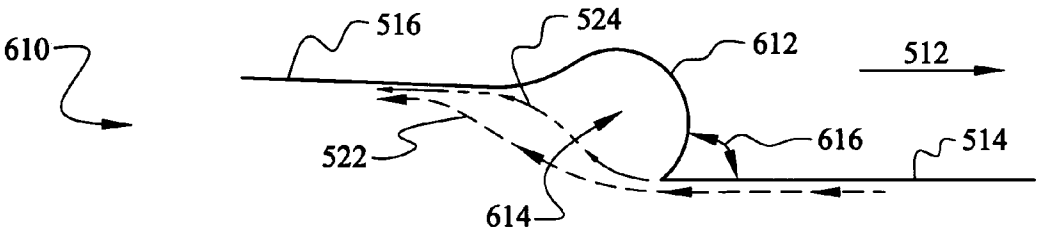
FIG. 6 depicts a schematic detail cross-section view of a second step arrangement.
Figure 7:
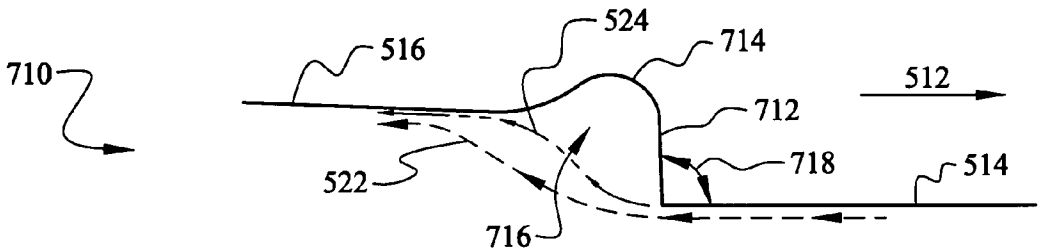
FIG. 7 depicts a schematic detail cross-section view of a third step arrangement.

FIGS. 5, 6, and 7 depict a cross-section view of three alternative configurations for at least one of the steps 126 and 128. While the three step configurations depicted in FIGS. 5, 6, and 7 do vary significantly, they do not represent the entire span of step configurations that fall within the scope of the slot-V hull system, but rather are only illustrative of some of these varieties and are not intended to be limiting. The step configurations depicted in FIGS. 5, 6, and 7 are also illustrative of some of the varieties of the topographic features' sets of contours as well, though again they are not limiting of the full range of the topographic features' sets of contours that lie within the scope of the slot-V hull system. In many cases the contours of a topographic feature and the configuration of the step whose ventilation it facilitates will closely correspond, but this is not required, and in certain embodiments of the present invention substantial differences may prove preferable. Additionally, it may prove beneficial to have a particular topographic feature that facilitates the ventilation of a fore step and which has a close correspondence in contours to the configuration of that fore step, whereas another topographic feature which facilitates the ventilation of an aft step does not have a close correspondence between its contours and the configuration of that aft step, or vice-a-versa.

In discussing the contours of topographic features it is useful for clarity of description purposes to define a topographic feature-specific coordinate system. Such a topographic feature-specific coordinate system can be defined relative to a general course that the ventilating airflow is influenced to follow by the topographic feature. One such general curvilinear airflow course coordinate system is defined herein as consisting of a course length dimension that follows the general route of the ventilating airflow, a course width dimension in a direction transverse to the length direction and generally parallel to the hull exterior surface, and a course depth dimension in a direction transverse to the length direction and generally normal to the hull exterior surface. Referring then to this curvilinear airflow course coordinate system, the plane in which FIGS. 5, 6, and 7 are disposed is perpendicular to the course length dimension, with the course width dimension being horizontally disposed and the course depth dimension being vertically disposed in FIGS. 5, 6, and 7. The variations between differing forms of steps and/or topographic features can be subdivided then into two primary classes. A first class generally includes differences in the course length dimension, such as variations in the length of the route the airflow follows or variations in the layout along the vessel hull that a specific airflow route follows. A second class generally includes variations in the cross-section of the step and/or topographic feature that the airflow passes, the second class being describable in terms of the course length dimension and the course width dimension such as the three cross-section variations depicted in FIGS. 5, 6, and 7.

In FIG. 5 a first step cross-section 510 is schematically depicted with the forward motion direction of the vessel being indicated by arrow 512. The elements of the first step cross-section 510 (as well as the step cross-sections depicted in FIGS. 6 and 7) are described herein, where applicable, in reference to the forward motion direction of the vessel such that a portion of the step cross-section that is forward of the step is indicated by the prefix "pre" and a portion of the step cross-section that is aft of the step is indicated by the prefix "post". A pre-step hull bottom surface section 514 extends downwardly further than does a post-step hull bottom surface section 516 by a distance that is approximately equal to the height of a first step surface 518. The first step surface 518 is disposed approximately perpendicularly to the pre-step hull bottom surface 514 and the post-step hull bottom surface 516. For ease of manufacturing, it is generally preferable that the first hull arrangement 110 be capable of construction with a single mold, when constructing the marine vessel from fiberglass for example, and removal of the molded hull from the mold (referred to as mold relief) is aided by the first step included angle 520 being greater than 90° by at least 1 or 2 degrees. As the marine vessel moves forward at increasing speeds, water flows past the first hull bottom surface 113 in the opposite direction of arrow 512. Once the vessel has reached a certain speed, the flow of water past the first step cross-section 510 approximately takes the path 522, wherein it separates from the post-step hull bottom surface 516 for a certain distance. A spray flow also separates from the post-step hull bottom surface 516 once it passes the first step cross-section 510, although the spray flow path 524 tends to rejoin the immediate proximity of the post-step hull bottom surface 516 at a lesser post-step distance than does the water flow path 522. The term "spray" is used herein as an approximate description indicating a mixture of air and water in relatively equal parts. The spray flow path 524 is defined for purposes of description, and does not indicate a strict demarcation since the spray is a relatively amorphous entity that varies continuously in composition between greater and lesser portions of water relative to air. In general, the composition of the spray tends to contain a relatively greater proportion of air closer to a first post-step void 526, and tends to contain a relatively greater proportion of water closer to the water flow path 522. The spray flow path 524 is indicated herein to generally depict a path of the portion of the spray that has sufficient water density to be capable of producing a significant impulse when impacting a surface. Therefore, the spray flow path 524 generally indicates a trajectory that is capable of producing significant drag on the vessel if it impacts a portion of the hull bottom surface that substantially impedes the progress of the spray flow. As can be seen in FIG. 5, this is a less significant effect for the first step cross-section 510, but it can be a more significant effect for other step cross-sections such as those depicted in FIGS. 6 and 7.

The first post-step void 526 is generally filled with water when the vessel is at rest, or traveling forward at slower speeds. As the vessel's speed increases, it tends to lift upward which, in combination with its forward motion, will produce a region of reduced pressure in the first post-step void 526. This reduced pressure in the first post-step void 526 will pull water and/or spray with a greater water density up into the first post-step void 526 and thereby tend to oppose the transition of the vessel to a planing attitude. In order to avoid this planing attitude opposing effect, the slot-V hull system facilitates ventilation of the first post-step void 526, most commonly through the ventilation facilitating action of the topographic features employed, although it is also within the scope of the present invention to also utilize alternative ventilation means, either in combination with at least one topographic feature or as an alternative to the use of topographic features. There are a significant variety of alternative ventilation means that are well know to those of skill in the art, including passive, powered, and engine exhaust gas ventilation systems. These preexisting means of ventilation differ in operation or construction from the inventive topographic features as described herein, in that they do not operate passively, extend both forward and upward from the region being ventilated, and are entirely a hull surface feature which does not entirely surround at least some portion of the route followed by the ventilating airflow. The inventive topographic features described herein, such as those depicted in FIGS. 5, 6, and 7, as well as the other topographic feature embodiments that fall within the scope of the present invention, will inherently act to facilitate the ventilation of the first post-step void 526 when the marine vessel's speed increases, which is the same condition that tends to create the first post-step void 526. Topographic features according to the slot-V hull system are thus seen to be capable of autonomously mitigating creation of reduced pressure in any or all of the first post-step void 526, and the aft slot aspect section 124, the fore slot aspect section 125, when the marine vessel's speed increases so that the vessel can reach, and then maintain, a planing attitude more quickly, with lesser power and fuel consumption requirements.

Certain alternative embodiments (not shown) of the present invention have hull arrangements which do not include a slot. Certain of these alternative hull arrangements have at least one post-step hull portion with a significantly lesser dead-rise angle than that of at least one pre-step hull portion. This greater flatness of the post-step hull portion is also capable of giving rise to the planing attitude opposing effect described in the immediately prior paragraph. These slotless embodiments will generally also include at least one topographic feature that facilitates ventilation of the region of the first post-step void 526 and thereby also facilitates the marine vessel's transition to a planing attitude. Though these embodiments are not explicitly depicted herein, their particulars are readily construed from the embodiments depicted. For the embodiments not explicitly shown herein, including those that do not have any slot aspect, their specifics are comprised of various selected assortments of elements from a group of elements that includes, but is not limited to:

1) At least one slot aspect;
2) At least one topographic feature;
3) At least one hull step;
4) A V-shaped fore hull portion;
5) And combinations thereof.

Embodiments of the slot-V hull system include, but are not limited to, a number of hull arrangements comprising novel and nonobvious assortments of the above elements. Among these inventive slot-V hull system element assortments are:

1) A primarily V-shaped fore-hull with at least one slot aspect that has the appropriate dimensional constraints, said dimensional constraints to be detailed following;
2) A primarily V-shaped fore-hull with at least one substantially flatter more aftward hull portion, wherein ventilation of said more aftward hull portion is facilitated by at least one topographic feature;
3) A primarily V-shaped fore-hull with at least one hull step, wherein ventilation of the region trailing said step is facilitated by at least one topographic feature;
4) A primarily V-shaped fore-hull with at least one hull step and at least one slot aspect, wherein ventilation of at least one of said step and slot aspect is facilitated by at least one topographic feature;
5) Any of the assortments 1) through 4) above further combined with at least an additional one of the elements 1) through 5) above;
6) And combinations thereof.

Thus, a number of permutations of the individual elements and element combinations which are not shown fall within the scope of the present invention, and this can be readily understood by consideration of the first hull arrangement 110. Included in the first hull arrangement 110 are a primarily V-shaped fore hull, two hull steps, two slot aspects, and two pairs of topographic features. From the preceding description, it should be understood that differing assortments of elements than are depicted in FIG. 1 are also easily understood from inspection of FIG. 1. A first permutation (not shown) that falls within the scope of the present invention would be a hull arrangement in accordance with FIG. 1, with the exception that rather than two longitudinally separated sets of hull step, slot aspect and pair of topographic features, this alternative embodiment would have one set of a single hull step, a single slot aspect, and one pair of topographic features. Other permutations (not shown) that fall within the scope of the present invention include, but are not limited to, a hull according to FIG. 1 with the alteration(s) that:

1) The aft slot aspect section 124 and the fore slot aspect section 125 are configured as a single continuous slot aspect;
2) The fore (or aft) slot aspect section 125 (124) is absent;
3) Additional hull steps, slot aspects, or topographic features are also present (such as an addition of a third set of hull step, slot aspect, and topographic features);
4) Fewer hull steps, slot aspects, or topographic features are present (such as a hull arrangement with a single hull step, slot aspect, and pair of topographic features);
5) Differing numbers of topographic features and/or alternative topographic feature designs (also described in the claims) are utilized; and
6) Alternative slot aspect and/or hull step designs are utilized.

Two exemplary embodiments of alternative topographic feature and/or hull step designs are illustrated in FIGS. 6 and 7. Though these designs are termed step cross-sections, it should be understood that these design variations are also applicable to the design cross-sections of the topographic features, and that even a single topographic feature or hull step can have more than one cross-sectional design at differing points along its extent. In addition, a hull step can have a differing cross-sectional design than the topographic feature (s) which facilitate its ventilation. As discussed above, the disposition of the topographic features and/or hull steps can be similar to their respective dispositions in FIG. 1, or can be modified, in part or in whole, to account for additional design considerations. In FIG. 6, a second step cross-section 610 has a concave second step surface 612 that provides a rounded forward and upper boundary for a second post-step void 614. One of the additional benefits, relative to the first step cross-section 510, provided by the second step cross-section 610 is realized when this cross-section is also utilized for the topographic feature that provides ventilation to the second post-step void 614, as illustrated in FIG. 3 described previously. The additional ventilation benefit is effected by the greater capability of this cross-section, due to a more effective channeling of the atmospheric airflow, to facilitate atmospheric access to the region of the post-step void 614. As mentioned previously, a step and/or topographic feature with the second step cross-section 610 would also present greater construction complexity and cost. Since the second step included angle 616 is less than 90°, when constructing a hull with this step and/or topographic feature cross-section, it is necessary to either utilize a multi-part mold, or to form the hull in multiple parts and then join them into a single hull structure, either of which would increase hull construction costs. The relative gains and costs of this cross-section would then have to be evaluated for a determination of the appropriate topographic feature cross-section in a particular situation.

A third step cross-section 710 is an intermediate approach to the easier construction of the first step cross-section 510 and the improved ventilation performance of the second step cross-section 610. The third step cross-section 710 can be considered a type of composite of the first and second step cross-sections 510 and 610, respectively. The third step cross-section 710 has a flat, nearly vertical forward third step surface 712, and a concave upper third step surface 714 which bound a third step void 716. The third step cross-section 710 provides some of the ease of construction advantages of the first step cross-section 510 by virtue of its near vertical forward third step surface 712 which is inclined at a third step included angle 718 that is at least one or two degrees more than 90° to allow mold relief without using a multi-part mold or a multi-part hull. The ventilating capability of the third step cross-section 710, when utilized as a topographic feature cross-section, is greater than that of the first step cross-section 510, when utilized as a topographic feature cross-section, but lesser than that of the second step cross-section 610, when utilized as a topographic feature cross-section. Analogously, the ease and cost of construction of the third step cross-section 710, when utilized as a topographic feature cross-section, is also intermediate of those of the first and second step cross-sections, when they are utilized as topographic feature cross-sections. Once again, the relative gains and costs of this cross-section relative to the variety of alternatives will have to be evaluated for a determination of the appropriate topographic feature cross-section in a particular situation.

Figure 8:
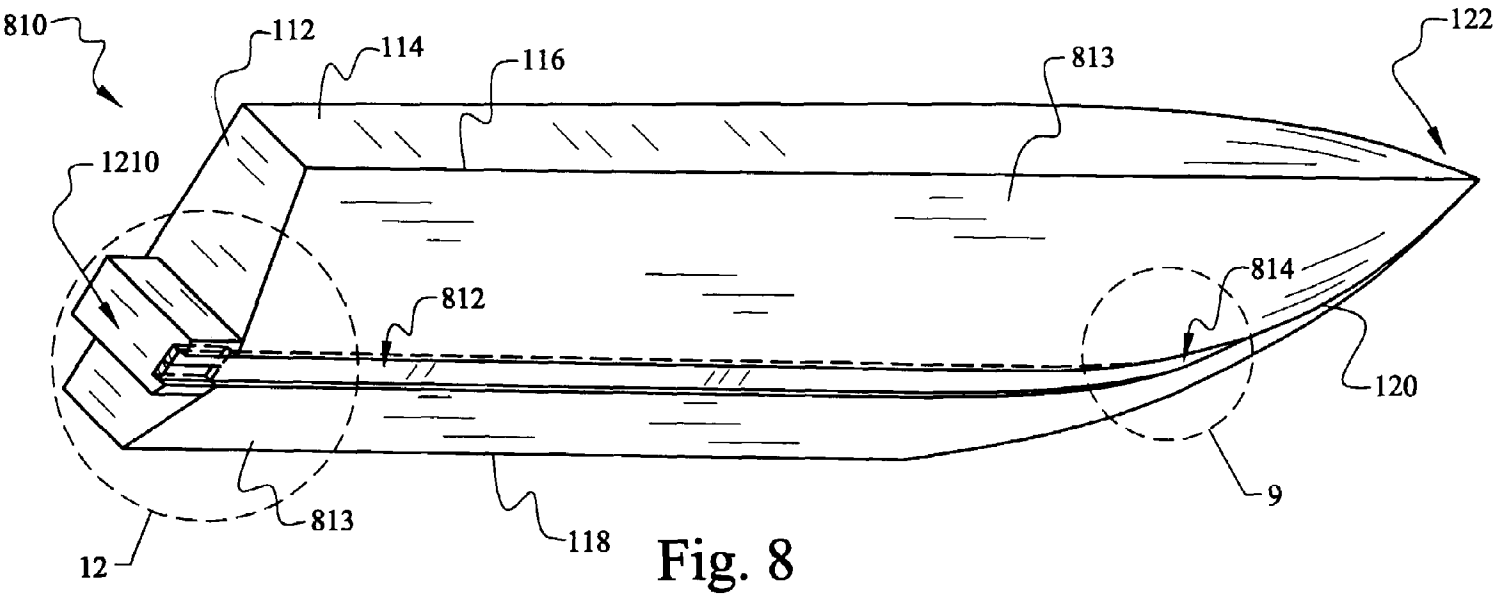
FIG. 8 depicts an upward and forward perspective view from a below, to the right side, and behind vantage point of a marine vessel hull arrangement according to a second embodiment of the present invention.

A second hull arrangement 810 representing a second embodiment of the present invention is shown in a mixture of overall, perspective, detail, and schematic views in FIGS. 8 through 11. FIG. 8 shows the underside of the second hull arrangement 810 for a marine vessel which has a number of components in common with the first hull arrangement 110 including the transom 112, a second hull bottom surface 813, the right side 114, the left side (not shown), the right chine 116, the left chine 118, the keel 120, and the bow 122. Among the cardinal features of the second hull arrangement 810 is a single central slot aspect 812, and a single central topographic feature 814. The central slot aspect 812 is a downwardly opening recess in the second hull bottom surface 813 that extends along the vessel's longitudinal center line. At its forward end, in the general vicinity of where the vessel's second hull bottom surface 813 slopes upward to form the underside of the bow 122, the central slot aspect 812 transitions into a central topographic feature 814. Dashed circle 9 circumscribes a region that includes the transition from the keel 120 to the forward end of the central topographic feature 814. The region within dashed circle 9 is shown in expanded detail in FIG. 9 and the detailed description of the central topographic feature 814 follows in the description of FIG. 9. In terms of the element assortments detailed previously, the second hull arrangement 810 is an embodiment of the present invention that includes both the 1) and 2) assortments of elements, whereas the first hull arrangement 110 is an embodiment of the present invention that includes all of the 1) through 4) assortments of elements. Alternative embodiments of the second hull arrangement 810, with differing permutations of the element assortments 1) through 4), including all 4 element assortments, can also be beneficial and lie within the scope of the present invention. As depicted in FIG. 8, the second hull arrangement 810 further includes an optional first slot aspect extension 1210. The first slot aspect extension 1210 is capable of providing multiple benefits, depending at least in part on its manners of utilization, the characteristics of the vessel it is a part of, and the situations in which and uses for which said vessel is operated. The specific details of the dispositions and applications of the first slot aspect extension are detailed in the description of FIG. 12, which is an expanded detail view of the area within dashed circle 12 of FIG. 8. It is important to note that the first slot aspect extension 1210 is optional, i.e. it is not required of the second hull arrangement 810 to also include the first slot aspect extension 1210. In those cases when the second hull arrangement 810 does not also include the first slot aspect extension 1210, the transom 112 is the aft end of the second hull arrangement 810.

Figure 9:
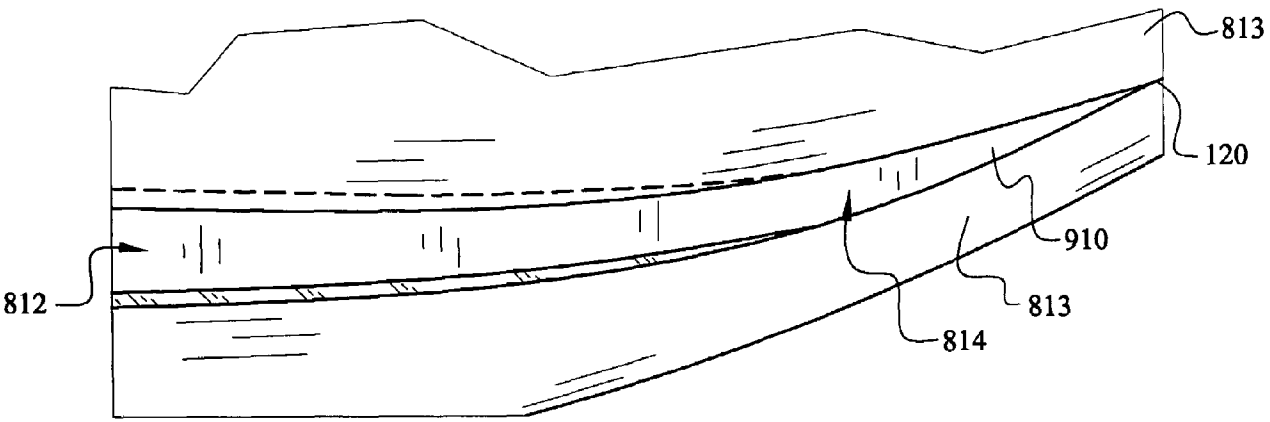
FIG. 9 depicts an expanded detail view of the area bounded by the dashed circle 9 of FIG. 8, showing the circumscribed portion of a fourth topographic feature arrangement.

As can be seen in FIG. 9, the central slot aspect 812 transitions seamlessly from the central topographic feature 814, although they are distinct in character. The central topographic feature 814 initiates, when moving rearward from the vessel's forwardmost tip, as a flattened spread 910 of the vessel's keel line 120, and does not begin to recess into the second hull bottom surface 813 until it's width approaches a significant fraction of the width of the central topographic feature 814. The differences in character that distinguish the central slot aspect 812 and the central topographic feature 814 include, but are not limited to:

1) The central slot aspect 812 is primarily submerged when the vessel is at rest, while a significant portion of the forward extent of the central topographic feature 814 may be (depending, at least in part, on the extent of the load on the second hull arrangement 810) above the resting water line;
2) The central slot aspect 812 maintains a relatively constant width and recess depth for the majority of its extent, while the central topographic feature 814 varies in width and depth (from none to approaching the central slot aspect 812 depth) for the majority of its extent;
3) The central slot aspect is at least partially under water, even when the vessel is at a planing attitude (excepting when the vessel leaves the water surface due to waves, for example), while the central topographic feature 814 is almost entirely out of the water when the vessel is at a planing attitude (excepting when the vessel encounters exceptionally high waves and or is landing back on the water); and
4) The central topographic feature 814 primarily serves to influence atmospheric gasses to access the region of the central slot aspect 812, while the slot aspect 812 itself serves to channel said atmospheric gasses along the length of the second hull bottom surface 813 to provide a ventilating action that eases the vessel's transitioning to an on-plane attitude, as well as improving the vessel's planing performance.

Figure 10:
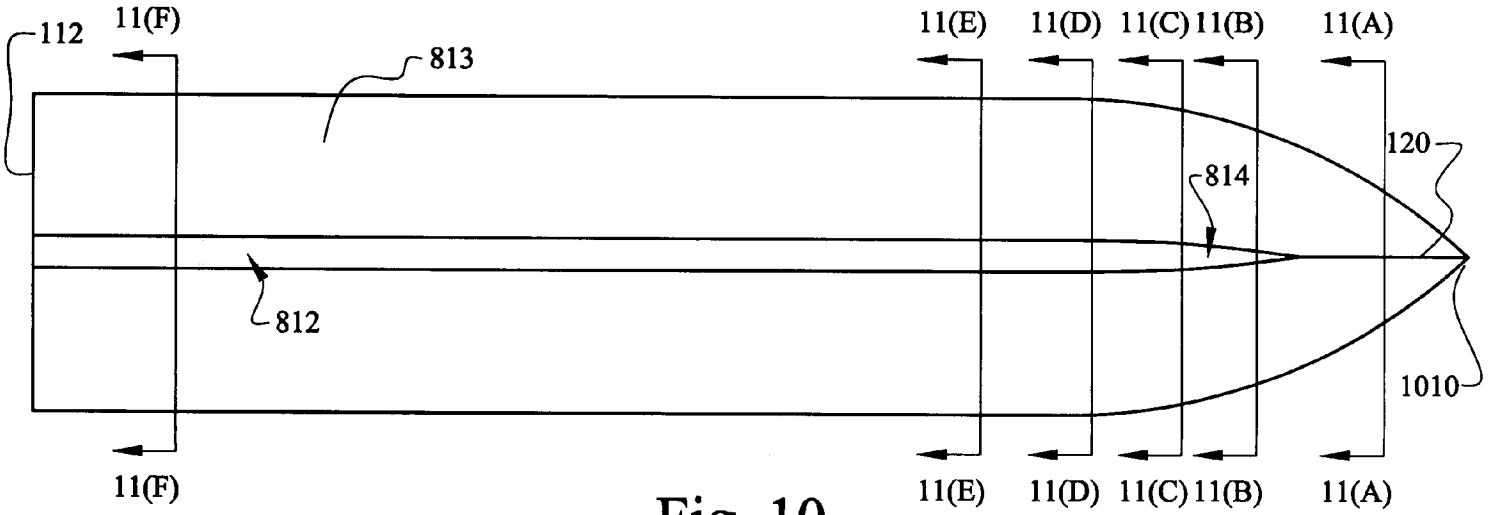
FIG. 10 depicts an upward view from a below vantage point of the second embodiment of the present invention.
Figure 11:
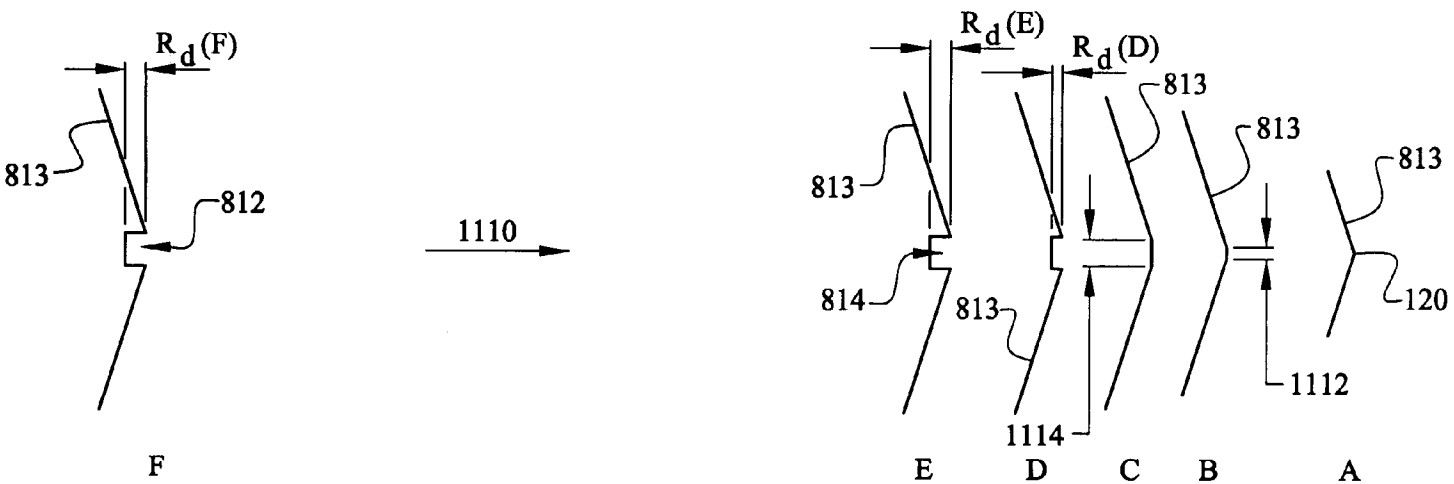
FIGS. 11 A-F depict schematic detail cross-section views of the lower outer hull surface of the second embodiment of the present invention, wherein views A-F correspond to the views along cutlines 11(A)-11(F), respectively.
Figure 13:
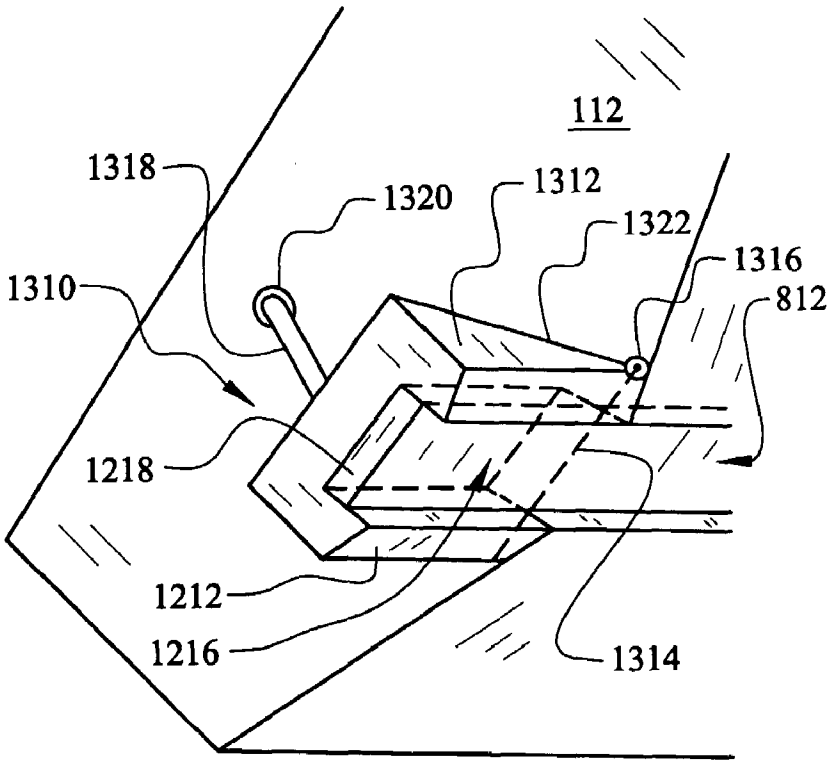
FIG. 13 depicts a first moveable slot aspect appendage that is also typically disposed within the expanded detail view of the area within dashed circle 12 of FIG. 8 (not shown in FIG. 8), as it would be disposed in relation to a second hull arrangement of a second embodiment of the present invention.
Figure 12:
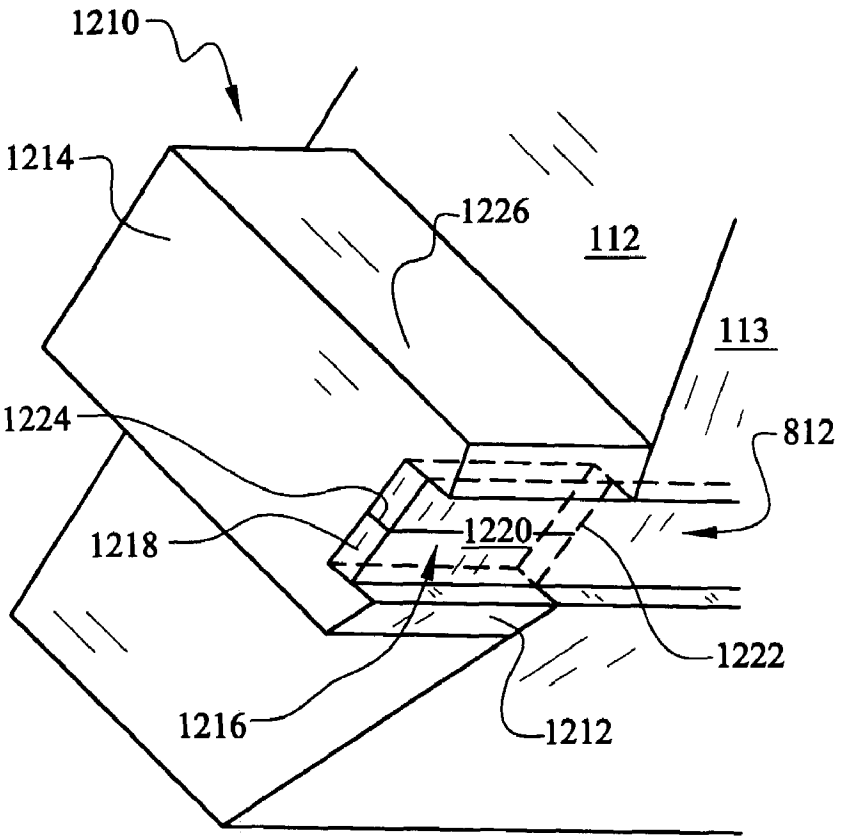
FIG. 12 depicts an expanded detail view of the area within dashed circle 12 of FIG. 8, illustrating a first slot aspect appendage.

FIGS. 10 and 11 provide relative dimensional details of the central slot aspect 812 and the central slot aspect 814, as well as their dispositional relationship. FIG. 10 is a view from below of the hull bottom second hull arrangement 810, with cut lines 11(A-F) demonstrating the planes of view of the cross-sections depicted in FIGS. 11 A-F. The views of the cross-sections 11 A-F depicted in FIG. 11 are oriented with the downward direction indicated by arrow 1110. In FIG. 11A, the FIG. 10 cut line 11(A) cross-section is seen to cross the second hull arrangement 810 at a point that is forward of the inception of the central topographic feature 814. In FIG. 11B, the FIG. 10 cut line 11(B) cross-section is seen to cross the central topographic feature 814 shortly after its inception, when the central topographic feature 814 is a slender flattened area of width 1112. In FIG. 11C, the FIG. 10 cut line 11(C) cross-section is seen to cross the central topographic feature 814 where it has reached a width 1114 that is the majority of the width of the central slot aspect 812, but prior to where the central topographic feature 814 has begun to recess upward into the second hull bottom surface 813. In FIG. 11D, the FIG. 10 cut line 11(D) cross-section is seen to cross the central topographic feature 814 where it has reached the width of the central slot aspect 812, and has begun to recess upward into the second hull bottom surface 813. At the longitudinal location of FIG. 10 cut line 11(D), the central topographic feature 814 has a depth $R_d$(D) which is greater than zero but has not yet reached a full recess depth $R_d$(E) of the central slot aspect 812 as shown in FIG. 11E which depicts the FIG. 10 cut line 11(E) cross-section of the second hull arrangement 810. In FIG. 11F, the FIG. 10 cut line 11(F) cross-section is seen to cross the central slot aspect 812 towards the aft end of the second hull arrangement 810, where the central slot aspect 812 is depicted as having essentially the same width 1114 and a depth $R_d$(F) that is also essentially the same as the recess depth $R_d$(E). The consistency in width and depth at the cut lines 11(E) and 11(F) are only one variant among the embodiments of the present invention, and a number of alternative variants are also encompassed. These alternatives can not only vary in either width or depth of the slot aspect, by either decreasing, increasing, or combinations thereof along the longitudinal extent of the central slot aspect 812, but can also differ in their profile shape, in their total slot aspect length (as depicted in FIGS. 12 and 13), as well as being capable of being configured with capabilities of changing their slot aspect's width, depth, cross-sectional profile, length, and even disposition while the vessel is in use (as depicted in FIG. 14). While FIGS. 8-11 depict the forwardmost reach of the central topographic feature 814 as terminating short of the foremost tip of the vessel, this is for illustrative purposes only. Alternative variants of the second hull arrangement 810 (not shown) that also fall within the scope of the present invention include variants wherein the central topographic feature 814 extends farther forward along the vessel's keel line 120 even all the way to the vessel's foremost tip 1010. Additional variants (not shown) of the second hull arrangement 810 include those wherein:

1) The flattened initiating region of the central topographic feature 814 extends farther forward, including as far as the vessel foremost tip 1010;
2) The recessed initiating region of the central topographic feature 814 extends farther forward, including as far as the vessel's foremost tip 1010;
3) The increasing width region of the central topographic feature 814 extends farther forward, including as far as the vessel's foremost tip 1010; and
4) Combinations of 1) through 3) above.

In addition to the diversity of embodiments described, as well as permutations of the differing elements and element assortments referred to herein that fall within the scope of the slot-V hull system, further variants in the disposition, construction, and dimensions of the slot aspect (not all shown) are also elements of the range of embodiments encompassed by the present invention. Among the manners in which these slot aspect variants are characterizable are as variations in a first cross-section profile. The first cross-section profile being transverse to a recess length, wherein the recess length is a dimension that tracks the path followed by ventilating gasses. The recess length dimension is capable of being linear, curvilinear, continuous, discontinuous, or combinations thereof. A first manner in which these slot aspect variants are characterizable involves the first cross-section profile having at least one attribute selected from a group consisting of:

a) at least one rectilinear side;
b) at least one arcuate side;
c) at least one substantially continuous change in slope;
d) at least one substantially discontinuous change in slope;
e) a disposition that is symmetrical about a vertical plane;
f) a disposition that is asymmetrical about a vertical plane;
g) a disposition that is symmetrical about a horizontal plane;
h) a disposition that is asymmetrical about a horizontal plane;
i) a disposition that is symmetrical about a diagonal plane;
j) a disposition that is asymmetrical about a diagonal plane;
k) at least one positive change in slope;
l) at least one negative change in slope;
m) and combinations thereof.

A second manner in which these slot aspect variants are characterizable involves the slot aspect recess delineating a cross-section silhouette, wherein the cross-section silhouette is capable of varying along the length of the slot aspect recess and generally includes at least a partial opening in a lower part of said cross-section silhouette. The cross-section silhouette is transverse to the recess length dimension, and at least a portion of the cross-section silhouette generally approximates at least one shape selected from a group consisting of:

a) a rectangle;
b) a trapezoid;
c) a triangle;
d) a polygon having at least five sides;
e) an M-shape;
f) an ellipsoid;
g) an elliptic section;
h) a conic section;
i) a parabolic section;
j) a hyperbolic section;
k) an overall shape that is subdivisible into parts of differing types of shapes, these types of shapes including at least one arcuate type of shape selected from a group consisting of the shapes f)-j) immediately above, and at least one non-arcuate type of shape selected from a group consisting of the shapes a)-e) immediately above;
l) an overall shape that is subdivisible into parts of repeating types of shapes, these types of shapes selected from a group consisting of the shapes a)-j) immediately above;
m) and combinations thereof.

In addition, embodiments (not all shown) comprising supplementary variants of the slot aspect that are characterizable according to at least one supplementary member that is at least partially disposed within at least a portion of at least one slot are also encompassed by the present invention. These supplementary members are capable of being disposed within any portion of any slot that provides sufficient space for a particular disposition of a specific supplementary member. The supplementary members can have capabilities of being articulated, of passively moving in response to ambient forces or conditions, of actively moving in response to controlled applications of forces or conditions, or combinations thereof. A representative sampling of some, but not all, of these slot aspect supplementary variants are depicted in FIG. 14 and explicated in the corresponding detailed description.

FIG. 12 is an expanded detail view of the area within dashed circle 12 of FIG. 8, depicting the first slot aspect appendage 1210. The first slot aspect appendage 1210 interconnects with the transom 112 and includes a slot aspect extension 1212 that provides an augmentation to the central slot aspect 812. The first slot aspect appendage 1210 is comprised of a slot aspect appendage housing 1214 which extends aftward from the transom 112 and includes the slot aspect extension 1212 in its lower portion. In the case of the first slot aspect appendage 1210 as depicted, the slot aspect extension 1212 continues aftward the general form of the central slot aspect 812 in so far as a first appendage recess 1216 formed into the underside of the first slot aspect appendage 1212 has substantially the same longitudinally-transverse cross-section as does the central slot aspect 812. Although this particular longitudinally-transverse cross-section does provide significant benefits, it is not the only such slot aspect recess longitudinally-transverse cross-section that can be beneficial, and in certain instances alternative cross-sections can be just as, if not more, beneficial. The first slot aspect extension 1212 can also employ these alternative slot aspect cross-sections, either in correlation to alternative variants of the second hull arrangement 810 comprising alternative slot aspect cross-sections, or in disparity to a particular slot aspect cross-section utilized in the second hull arrangement 810 or alternative variants thereof. These alternative slot aspect cross-sections are also capable of being articulated, time-varying, varying by selective or automatic control, as well as differing in differing portions of a given slot aspect. Selected exemplary cases that illustrate the breadth of variations in slot aspects encompassed by the slot-V hull system are depicted in FIG. 14 and are explicated more fully in the corresponding detailed description of FIG. 14. A first example of a selectively varying slot aspect cross-section is illustrated in FIG. 12, which depicts an inclusion of an optional selectively movable slot aspect roof section 1218. The moveable slot aspect roof section 1218 is shown in a withdrawn position wherein it is fully retracted upward into the slot aspect appendage housing 1214. A lower outer surface 1220 of the movable slot aspect roof section 1218 forms the recess upper boundary surface of the slot aspect extension 1212. When in the withdrawn position, this upper boundary surface of the first appendage recess 1216 comprises a generally unchanged aftward continuation of the central slot aspect 812. The movable slot aspect roof section 1218 is capable of pivoting downward about its forward edge 1222, and when so pivoted downward the cross-section of the first appendage recess 1216 has a progressively diminishing height when moving aftward along the slot aspect extension 1212.

Depending on the circumstances of use and the vessel wherein utilized, the aftward continuation of the slot aspect, as well as its capability of selectively altering its cross-section, can provide additional benefits such as an anti-blow-over effect. The blow-over effect can occur if a vessel, when launching off a particularly large and steep wavefront for example, achieves such a steep attitude relative to its direction of motion that the air impacting its underside is capable of flipping the vessel over. Blow-overs are potentially catastrophic events that can destroy a vessel and imperil the welfare of any occupants of the vessel. The slot aspect extension 1212, in providing an additional surface area that extends aftward beyond the transom 112 for the airflow to impact, will tend to counter the impact of the airflow on the forward portions of the vessel, and thereby mitigate the tendency to flip. The slot aspect extension 1212 is capable of mitigating the tendency to flip in at least two manners. The first manner is by providing an aftward extending surface that, when impacted by airflow or waterflow, will push upward at the stern of the vessel, and hence work against the upward airflow lift at the bow of the vessel that will tend to rotate the vessel downward at the stern. In the potential blowover situation being discussed, the forces acting on the vessel are decomposable into lift acting in the vertical direction, and drag acting opposite the primary direction of motion which is chiefly horizontal. The bow-lifting rotation that presents a risk of blowover also results in induced drag on the slot aspect extension 1212 and the lower surfaces of the slot aspect appendage 1210. The second manner in which the blowover risk is mitigated is due to the slot aspect extension 1210 producing increased drag acting on the lower aftward portions of the vessel, which at least partially counters the blow-over-impelling torques that are acting primarily on the fore portions of the vessel. A significant number of vessels employing the slot-V hull system will have centers of mass that are disposed substantially more aftward than the longitudinal center of the vessel due to the performance and other advantages such a configuration provides. This configuration does, though, increase the potential for blowover because a greater part of the vessel's hull will be disposed forward of the center of mass than aftward, and when the vessel is at an attitude that presents a risk of blowover the airflow impacting on the portion of the hull's underside that is disposed forward of the center of mass will tend to contribute to bringing about blowover. Here too the slot aspect appendage 1210 can provide a further mitigating effect by its greater likelihood of impacting the water's surface than the likelihood of the vessel's transom impacting the water's surface when the vessel is at risk of blowover. Since the dynamic pressure of water is over 800 times greater than that of air, the slot aspect appendage 1210 will not require very much contact with the water surface in order to produce a substantial countering effect to the aerodynamic forces that have the potential to cause blow-over. Due to the slot aspect extension 1212 continuation of the ventilating effect of the central slot aspect 812, the first slot aspect appendage 1210 will produce less drag than a simple hull undersurface extension would, and hence the first slot aspect appendage 1210 can provide the anti-blow-over effect with lesser detrimental consequences than would a hull appendage that does not include a slot aspect. Slot aspect appendages according to the present invention are capable of providing a number of benefits, including the anti-blow-over effect. Among these beneficial capabilities are:

a) Anti-blow-over effect;
b) Anti-porpoising effect;
c) Trim control augmentation;
d) Center-of-lift disposition control augmentation; and
e) Improved lateral stability in rough water.

A vessel is said to be porpoising when, as it progresses across the water, it tends to execute a continuing series of alternating positive and negative pitch rotations. Depending on a vessel's characteristics, environmental conditions, and operating parameters, a vessel's susceptibility to porpoising can be difficult to control, and, once porpoising has initiated, it is capable of being self-propagating. As is readily apparent, porpoising is capable of greatly compromising the vessel's performance, and can be uncomfortable for the vessel's occupants. Slot aspect extensions such as slot aspect extension 1212 are capable of providing the anti-porpoising effect in a similar manner to the previously described second manner of mitigating blowovers, by reducing the vessel's potential for porpoising by decreasing the amplitude of the lifting of the bow as it rebounds from the water. Since one major hazard of porpoising is its potential for self-propagation, the present invention's stabilizing counter effect during pitch oscillation can dampen or even eliminate continuation of the oscillation.

Slot aspect extensions are capable of providing trim control augmentation by functioning analogously to trim tabs, primarily to influence the vessel's pitch attitude, although certain embodiments of the present invention can utilize a plurality of slot aspect extensions or multipart slot aspect extensions to also influence the vessel's yaw and/or roll attitudes. The means by which a slot aspect extension influences any of a vessel's pitch and/or yaw and/or roll attitudes are similar to conventional trim tabs' operation and as such are readily apparent to those of ordinary skill in marine vessel construction and operation. The manner in which slot aspect extensions are able to operate analogously to trim tabs involves slot aspect extension variants being constructed with capabilities of being movable, including while the vessel is in operation, so that the slot aspect extension's aerodynamic and hydrodynamic effects on the vessel are selectively variable. When at least a portion of a particular slot aspect extension embodiment is capable of varying its relative vertical position, either by translation, rotation, or both, that particular embodiment is capable of influencing a vessel's pitch attitude. For example, the slot aspect extension 1212 with the inclusion of the selectively movable slot aspect roof section 1218 is such a slot aspect extension embodiment that is capable of augmenting a vessel's pitch trim control.

When a particular slot aspect extension embodiment, which may involve multiple individual slot aspect extensions, is capable of varying a relative vertical disposition of at least a first portion of at least one slot aspect extension, either by translation, rotation, or both, so that the first portion has a different vertical disposition than the vertical disposition of at least a second portion of that slot aspect extension embodiment, and these first and second slot aspect extension portions have differing relative lateral dispositions, then that particular embodiment is capable of influencing a vessel's pitch and/or yaw and/or roll attitudes. The slot aspect extension 1212 with the inclusion of a longitudinally subdivided variant of the selectively movable slot aspect roof section 1218 is such a slot aspect extension embodiment that is capable of influencing a vessel's pitch and/or yaw and/or roll attitudes. A longitudinally subdivided variant of the selectively movable slot aspect roof section 1218 is divided along a longitudinal plane 1224 so that a left side of the selectively movable slot aspect roof section 1218 is capable of altering its inclination by pivoting about the forward edge 1222 separately from the inclination of the right side of the selectively moveable slot aspect roof section 1218. This slot aspect extension embodiment is capable of providing limited degrees of pitch and/or yaw and/or roll attitude control, but a related slot aspect extension embodiment (not shown) with a pair of slot aspect extensions 1212, each disposed a selected distance towards each of the vessel's sides from the vessel's longitudinal central plane, and each including a selectively movable slot aspect roof section 1218, is capable of providing greater degrees of control. A slot aspect appendage side wall 1226, in addition to contributing to the structural integrity of the slot aspect appendage 1210, is also capable of providing a degree of stabilizing effect when the vessel assumes attitudes that present potential risks of control loss. One such scenario would be when the vessel is airborne, such as when launching off of a large wave, and the vessel encounters significant side winds or is impelled upward at a disposition that is angled relative to its primary direction of motion. In these cases, the fluid-dynamic effects that impact the vessel in manners that are not congruent with its intended direction of travel could turn or roll it so that when it next meets the water the vessel is in an attitude that presents potentially significant risks of control loss, or even damage. The slot aspect appendage side walls 1226 can help to mitigate this risk by providing a form of air and/or water rudder effect, that would tend to keep the vessel within the range of safe attitudes, relative to its primary direction of travel, similar to how the tail on an airplane works. Additional slot aspect extension variants, including those that are capable of providing degrees of pitch and/or yaw and/or roll trim control are shown in FIG. 14 A-N and delineated in the following corresponding portions of this detailed description.

FIG. 13 depicts a first selectively deployable slot aspect appendage 1310, in a first extended disposition. The first selectively deployable slot aspect appendage 1310 comprises a deployable slot aspect appendage housing 1312, the lower extent of which is effectively comparable to the lower extent of the first slot aspect appendage 1210, and accordingly also includes the slot aspect extension 1212, the first appendage recess 1216, and can also include the optional first moveable slot aspect roof section 1218. A salient distinguishing feature of the selectively deployable slot aspect appendage 1310 is its capability of assuming a range of dispositions by pivoting about a rotational axis 1314 which is disposed parallel to the transom 112 in a generally horizontal disposition. A pivot assembly 1316 rotatably interrelates the selectively deployable slot aspect appendage 1310 with the transom 112 so that the selectively deployable slot aspect appendage 1310 is capable of pivoting about the rotational axis 1314. An actuator 1318 interconnects the selectively deployable slot aspect appendage 1310 with the transom 112 at an actuator linkage 1320 that comprises a mechanism for selectively enacting pivoting about the rotational axis 1314. The selectively deployable slot aspect appendage 1310 is capable of being disposed at inclinations that effectively extend the central slot aspect 812 so that the first appendage recess 1216 is capable of being disposed at a range of inclination angles relative to the transom 112. The range of first appendage recess 1216 dispositional inclination angles is delimited by the constraints on the range of motion available to the selectively deployable slot aspect appendage 1310. The selectively deployable slot aspect appendage 1310 is capable of rotating upward about the rotational axis 1314 until an upper margin 1322 meets the transom 112, and is further capable of rotating downward to dispositional angles wherein the lower outer surface 1220 angles downward, relative to the general inclination of the upper surface of the recess formed into the central slot aspect 812, as the lower outer surface 1220 extends aftward from the rotational axis 1314. Beyond the multiplicity of benefits during standard operations that are realizable with the selectively deployable slot aspect appendage 1310, its capability of being disposed at a downward inclination as it extends aftward can also be utilized to provide an additional anti-blowover action, by the actuator disposing the aft end of the selectively deployable slot aspect appendage 1310 at a substantial downward inclination when the vessel is at risk of blowover. When disposed thus downward, the selectively deployable slot aspect appendage 1310 works as a water and/or air deflector that would tend to raise the aft end of the vessel and thereby counter any vessel rotational motion that presents a risk of blowover. The selectively deployable slot aspect appendage 1310 is also capable of incorporating the selectively moveable slot aspect roof section 1218 and thereby provide a vessel with capabilities of effecting a substantially greater range of slot aspect appendage recess roof dispositions. Whereas, in principle, the specific manners in which the selectively deployable slot aspect appendage 1310 is configured, in how its movement is effected, in what types or extents of motion it is capable of, or in how that motion is actuated or controlled are all capable of being accomplished in widely varying ways, in practice a number of vessel design considerations will often entail that certain options are preferable (for example, constructing a vessel of relatively small size will impose limits on the sum weight of a particular realization of a selectively deployable slot aspect appendage embodiment). These design considerations do not, however, limit the multiplicity of manners of realizing a selectively deployable slot aspect appendage that are encompassed by the scope of the present invention, but rather only limit the practical options that are well suited for specific vessels. Moreover, slot aspect appendages such as described above are also capable of being arranged with a detachable capability, so that a vessel according to the present invention is capable of embarking on one type of voyage, in one set of conditions, utilizing a particular slot aspect appendage that is well suited for those circumstances, and on another voyage in a differing set of conditions that vessel can embark without a slot aspect appendage when such an arrangement is better suited for those differing circumstances.

FIG. 14 A-N depict schematic cross-sections of a sampling of the range of varieties of slot aspect recess realizations according to the slot-V hull system. The orientation of the points of view FIGS. 14 A-N are cross-sections taken transverse to the vessel's longitudinal axis, facing the fore end of the vessel when it is in an upright disposition, with the vessel's left side to the left of the view depicted in FIGS. 14 A-N. In all of FIGS. 14 A-N the hull bottom surface 113 is seen to continue outward and upward at a moderate dead rise angle to the right and the left. The dead rise angle as shown is merely depicted for illustrative purposes, and is not limiting of the range of dead rise angles, both steeper and shallower, with which the present invention is capable of being realized. Moreover, a specific slot aspect can comprise more than one slot aspect recess configuration at differing longitudinal positions. As will be described subsequently, a single slot aspect recess configuration may also be capable of altering its configuration, even while the vessel is in operation in certain embodiments. Additionally, although the slot aspect recess varieties as shown in FIGS. 14 A-N imply that the vessel is arranged with a single slot aspect, this is only for purposes of clarity. It is envisioned that certain embodiments of the present invention will comprise more than one slot aspect, separated longitudinally and/or laterally, and that at least some portions of these slot aspects are capable of having differing slot aspect recess configurations than other portions of the same or a separate slot aspect. The present invention encompasses nearly any permutation and/or combination of these slot aspect recess configurations, as well as combinations of elements from one schematic slot aspect configuration mingled with elements of one or more other slot aspect recess configurations. The various slot aspect recess configurations can comprise varying cross-section profiles and silhouettes, varying manners of altering the slot aspect recess cross-section profiles and silhouettes, as well as varying manners of effecting said altering of the slot aspect recess profiles and silhouettes.

Figure 14A:
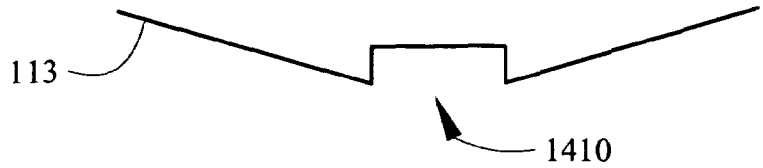
FIGS. 14 A-N depict cross-sectional views of a number of variant embodiments of slot aspects according to the present invention.
Figure 14B:
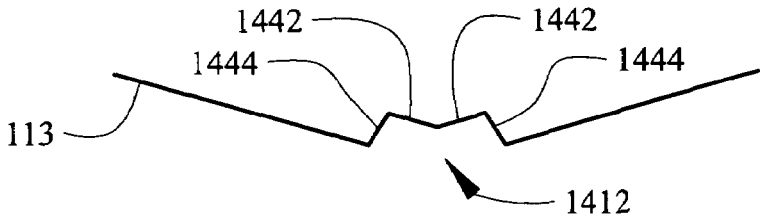
Figure 14C:
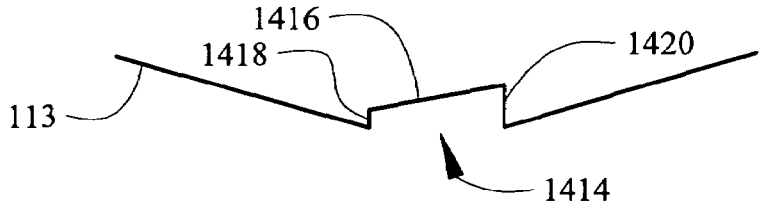
Figure 14D:
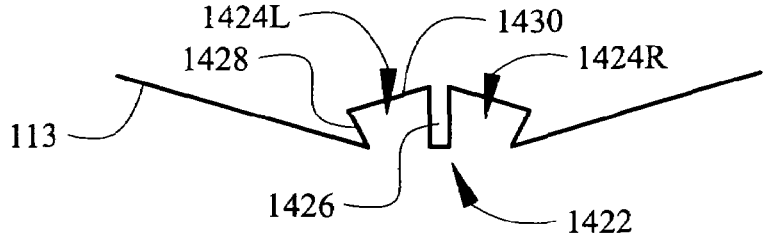

Of the range of slot aspect recess cross-sections described herein, many will often be suitable for one set of marine conditions, or vessel characteristics, or projected manners of vessel operation, but not for others, and as described previously a multitude of design considerations will be involved in determining the appropriate selection for a particular vessel, conditions, and projected operational objectives. A first slot aspect recess cross-section 1410 depicted in FIG. 14A has a cross-section profile with the general shape of an open bottomed rectangle. A second slot aspect recess cross-section 1412 depicted in FIG. 14B has a cross-section profile generally similar to a flattened M-shape, wherein the outside legs of the "M-shape" are angled inward from bottom to top. A third slot aspect recess cross-section 1414 depicted in FIG. 14C has a laterally asymmetrical shape with a sloped planar slot aspect recess roof 1416, wherein a left slot aspect recess wall 1418 is of lesser height than a right slot aspect recess wall 1420. Such a laterally asymmetrical third slot aspect recess cross-section 1414 can be of benefit, for example, when the vessel is expected to operate in an environment which will present consistently asymmetrical conditions, such as a river ferry that will consistently be required to navigate conditions that differ greatly during one leg of its round trip from the conditions it navigates during the return leg of its round trip. A fourth slot aspect recess cross-section 1422 depicted in FIG. 14D has a bifurcated cross-section profile comprised of a pair of laterally asymmetrical insets 1424R and 1424L positioned towards the right and left sides, respectively, of the fourth slot aspect recess cross-section 1422. The insets 1424R and 1424L are essentially mirror images of each other, laterally separated by a longitudinal inset dam 1426 that depends downwardly from the upper boundary of the fourth slot aspect recess cross-section 1422. The longitudinal inset dam 1426 is disposed in a generally longitudinally central position, and in combination with the mirror image dispositions of the insets 1424R and 1424L, the fourth slot aspect recess cross-section 1422 provides a generally laterally symmetrical overall arrangement. As shown in FIG. 14D, the longitudinal inset dam 1426 has a not insignificant width that enables the longitudinal inset dam 1426 to both laterally divide as well as separate the insets 1424R and 1424L. The width of the longitudinal inset dam 1426 is capable of varying, with differing widths being capable of providing gradations in how the two insets' aerodynamic and hydrodynamic effects vary between operating in close unison when the width is small, up to operating in effective independence when the width is relatively great. An outer inset boundary wall 1428 slopes inward from top to bottom towards the longitudinal central plane in FIG. 14D, but it can also be sloped at varying inclinations (not shown) including vertical and outwardly sloping. Outside of the performance issues that influence the choice of inclination of outer inset boundary wall 1428, ease of construction can also influence the choice of inclination, since when the outer inset boundary wall 1428 is sloped inward from top to bottom, it is unlikely to be possible to construct such a hull arrangement with a single mold due to an inability to achieve mold relief with an inward slope as shown. It should also be noted that an inset upper boundary wall 1430 is also sloped at an angle relative to the horizontal. In the embodiment depicted in FIG. 14D, the inset upper boundary wall slopes downward in the outward direction. This slope can also be varied (not shown) both in degree of inclination as well as being capable of alternatively being horizontal or sloped upward towards the outward direction, the choice among these options again being influenced by various design, construction, and operational parameters.

Figure 14E:
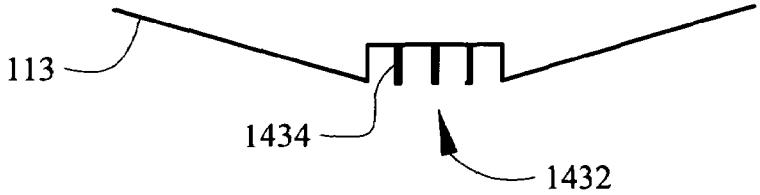

A fifth slot aspect recess cross-section 1432 depicted in FIG. 14E has an overall outline similar to the first slot aspect recess cross-section 1410 with the addition of three slot aspect recess partitions 1434. The slot aspect recess partitions 1434 are shown in FIG. 14E as depending vertically downward from the roof of the slot aspect recess, although the inclination of these slot aspect recess partitions is capable of varying (not shown). Additionally, the total number of the slot aspect recess partitions, their lateral dispositions relative to the boundaries of the fifth slot aspect recess cross-section 1432, and the extent of their downward reach (including beyond the furthest downward reach of the slot aspect recess), relative to the depth of the fifth slot aspect recess cross-section 1432, are also capable of varying (not shown) depending of the aforementioned types of design criteria. The slot aspect recess partitions 1434 are distinguished from the longitudinal inset dam 1426 of the forth slot aspect recess cross-section 1422 by their distinctly thinner widths. Because the slot aspect recess partitions 1434 have relatively limited widths they are capable of providing at least a partial subdividing effect to the fifth slot aspect recess cross-section 1432, but are not capable of providing a substantial separating effect. The slot aspect recess partitions 1434, are also capable of being combined with any alternative overall outline such as the overall outline of the second slot aspect recess cross-section 1412 (not shown), for example. The slot aspect recess partitions 1434 can also be inclined at angles other than the vertical (not shown), including horizontal (wherein they would be interconnected with the outer boundary walls of the fifth slot aspect recess cross-section 1432) and various diagonal angles.

Figure 14F:
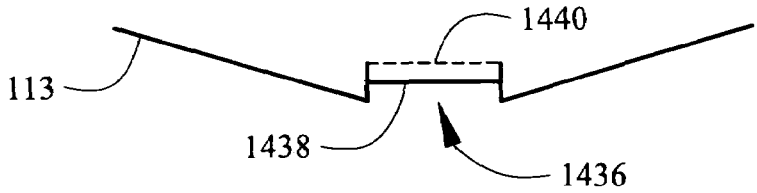

The manners in which elements of the various slot aspect recess cross-sections are capable of being utilized also encompasses degrees of articulation, as well as various movement capabilities. In general, a constituent and/or property of a slot aspect that is capable of providing these articulation and movement capabilities are termed, when referred to collectively, as a quality of a slot aspect or a slot aspect extension, where appropriate, in the specification and claims contained herein, although particular individual parts and/or facets of an embodiment may also be referred to by other terms when useful for purposes of distinction. A sixth slot aspect recess cross-section 1436 depicted in FIG. 14F shows a first slot aspect moveable element 1438. The first slot aspect moveable element 1438 functions as a moveable slot aspect recess upper boundary wall, translating vertically between an uppermost boundary wall position 1440 and the lowermost reach of the sixth slot aspect recess cross-section 1436. The means of effecting or controlling the motion of the slot aspect moveable element 1438 are not constrained in principle, and are constrained in practice only by practicality and design considerations. These means of effecting or controlling motion can be passive or active, powered or ambiently impelled, and selectively, autonomously, or automatically instigated. Passive means will operate without a specifically directed input, such as in response to a given sensed vessel speed, and active means will operate in response to an expressly directed input, such as a user selecting a given first slot aspect moveable element 1438 disposition according to an anticipated vessel speed. Powered means will utilize at least one power source, such as an electric motor, to impel the vertical translation, while ambient means will utilize ambient conditions, such as the surface pressure upon a portion of the vessel or inertial forces resulting from turning the vessel, to impel the vertical translation. Selective means of effecting the vertical translation will operate in response to a determination by a human or other control system, autonomous means will operate without a determination, and automatic means will operate in response to a predetermination. These various means of effecting or controlling the motion of the moveable slot aspect recess moveable element 1438, and combinations thereof, also apply to the other slot aspect recess moveable elements described herein. The scope of the present invention also encompasses alternative slot aspect recess cross-sections wherein the moveable element is a portion of the slot aspect overall outline that differs from the upper boundary wall as depicted in FIG. 14E, such as an alternative variant of the third slot aspect recess cross-section 1414 wherein the right slot aspect recess wall 1420 is horizontally moveable.

Among the slot aspect moveable elements' various movement capabilities are overall translations, such as in the case of the first slot aspect moveable element 1438; rotations about various rotational axes, such as an alternative variant of the sixth slot aspect recess cross-section 1436 (not shown) wherein the first slot aspect moveable element 1438 is alternatively capable of rotating about at least one of its lateral endpoints where it meets a side boundary wall of the slot aspect recess; and combinations thereof. The location of a rotational axis is not required to be disposed at an endpoint of a particular slot aspect moveable element, but can also be disposed at an intermediate point of the slot aspect moveable element, and a particular slot aspect moveable element is also capable of being rotatable about more than one rotational axis. Included among the slot aspect moveable elements' various degrees of articulation are alternative variants of the representative sample of slot aspect recess cross-sections explicitly depicted herein, wherein these alternative variants involve at least one constituent of these cross-sections including at least one point of articulation. The types of articulation are not restricted in principle, other than the necessity of ensuring that any point of articulation maintain a relatively watertight interconnection if that point of articulation is potentially exposed to water, and said types of articulation are capable of involving relative translations, relative rotations, or combinations thereof. An example of an alternative slot aspect recess cross-section variant with an articulated slot aspect moveable element (not shown) is the second slot aspect recess cross-section 1412 wherein the central juncture between the downwardly depending upper boundary sections 1442 becomes a pivotal interconnection so that the relative vertical position of the pivotable central juncture has a variable elevation capability (which will also involve either the downwardly depending upper boundary sections 1442 being capable of varying their length and their angle of juncture with outer boundary walls 1444, and/or the outer boundary walls 1444 being capable of rotating about their junctures with the hull bottom surface 113). These alternative slot aspect cross-section variants are also capable of including articulated junctures within a slot aspect constituent element at dispositions where the slot aspect constituent element had been unarticulated in other embodiments. Representative examples of the addition of articulated junctures and/or additional movement capabilities include alternative variants of the fifth slot aspect recess cross-section 1434 that incorporate various forms of the above described movement and/or articulation capabilities are:

1. A first alternative variant of the fifth slot aspect recess cross-section 1432 wherein at least one of the slot aspect recess partitions 1434 includes a pivoting juncture disposed at its vertical midpoint, so that the lower portion of the then articulated slot aspect recess partition 1434 is thus capable of pivoting to the left or right;
2. A second alternative variant of the fifth slot aspect recess cross-section 1432 wherein at least one of the slot aspect recess partitions 1434 is capable of translating vertically (either by being capable of altering its overall length or by passing up or down through a slot aspect recess upper boundary wall akin to a selectively deployable keel plate);
3. A third alternative variant of the fifth slot aspect recess cross-section 1432 wherein the relative lateral disposition of at least one slot aspect recess partition 1434 is capable of being varied by translating horizontally;
4. A fourth alternative variant of the fifth slot aspect recess cross-section 1432 wherein at least two adjacent slot aspect recess partitions 1434 can pivot about their junctures with the upper boundary wall of the slot aspect recess so that they can meet at their lowest extents and form a triangular shape; and
5. Combinations thereof.

Figure 14G:
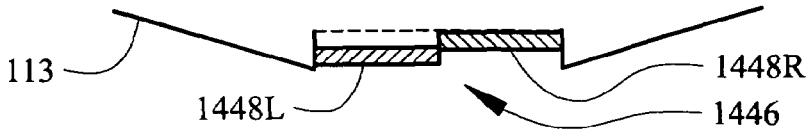

A seventh slot aspect recess cross-section 1446 depicted in FIG. 14G shows second slot aspect recess moveable elements 1448L and 1448R disposed on the left and right sides of the slot aspect recess cross-section, respectively. Each of the second slot aspect recess moveable elements 1448L and 1448R are capable of assuming a plurality of vertical dispositions, ranging between a lowest disposition corresponding to the depicted disposition of second slot aspect recess moveable element 1448L and a highest disposition corresponding to the depicted disposition of second slot aspect recess moveable element 1448R. The relative dispositions of the second slot aspect recess moveable elements 1448L and 1448R, respectively, can be controlled to operate independently, or can be interrelated in various ways such as upward translation of one movable element being associated with downward translation of the other.

Figure 14H:
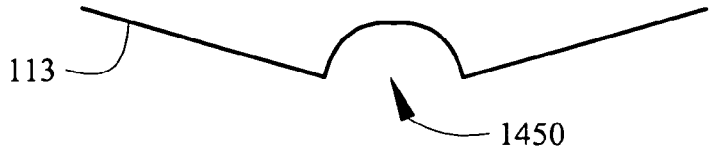
Figure 14I:
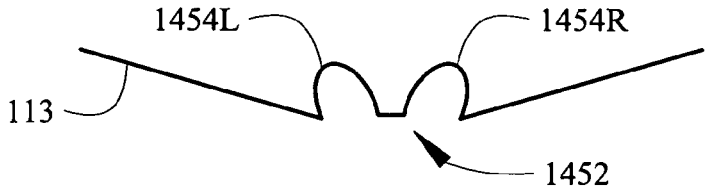
Figure 14J:
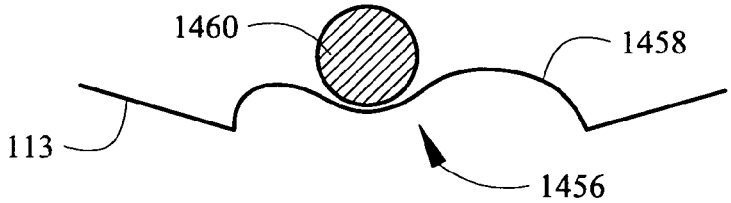

An eighth slot aspect recess cross-section 1450 depicted in FIG. 14H comprises a slot aspect recess with an arcuate profile. A ninth slot aspect recess cross-section 1452 depicted in FIG. 14I comprises a bifurcated cross-section profile analogous to the fourth slot aspect recess cross-section 1422, with the discrepancy that left and right laterally asymmetrical arcuate insets 1454L and 1454R, respectively, are delineated by arcuate boundaries rather than the polygonal boundaries of the left and right laterally asymmetrical insets 1424R and 1424L. A tenth slot aspect recess cross-section 1456 depicted in FIG. 14J comprises an arcuate profile with a resiliently deformable boundary 1458. The resiliently deformable boundary 1458, when not forcibly deformed, has a resting profile comparable to the eighth slot aspect recess cross-section 1450. A first recess boundary deforming element 1460 is schematically depicted in FIG. 14J as having a generally circular cross-section and is capable of moving both horizontally and vertically. The cross-sectional shape, particular disposition, directions of motion capabilities, and relative size of the first recess boundary deforming element 1460 are not limiting and are selected only for purposes of clarity of description. As the first recess boundary deforming element 1460 is translated downward, it presses on the resiliently deformable boundary 1458 and forces downward the portion of the resiliently deformable boundary 1458 immediately below the first recess boundary deforming element 1460 to thereby modify the profile of the recess bounded by the tenth slot aspect recess cross-section 1456. Alternative variants (not shown) of the tenth slot aspect recess cross-section 1456 can utilize variations in the size and/or shape and/or manners of motion of the first recess boundary deforming element 1460 as well as variations in the flexibility and/or size of the resiliently deformable boundary 1458 to provide additional manners of deforming the recess profile. Additionally, alternative variants of the first recess boundary deforming element 1460 can also operate through inflation, whereby alterations in its size are capable of effecting the deformation of the resiliently deformable boundary 1458.

Figure 14K:
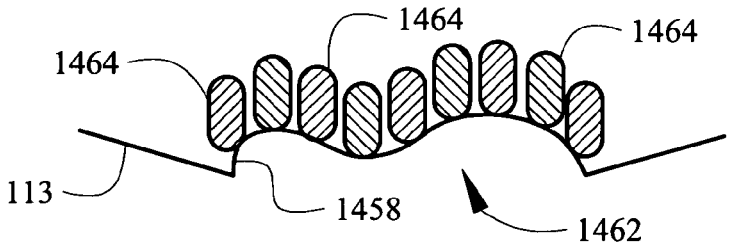

An eleventh slot aspect recess cross-section 1462 depicted in FIG. 14K also comprises the resiliently deformable boundary 1458, with an alternative operative manner of effecting deformation of said resiliently deformable boundary 1458. As depicted in FIG. 14K, a plurality of second recess boundary deforming elements 1464 are arrayed side by side across the width of the eleventh slot aspect recess cross-section 1462. While this arrangement of second recess boundary deforming elements 1464 is representative of the eleventh slot aspect recess cross-section 1462, alternative variants of this cross-section can comprise differing numbers of and differing individual or collective dispositions of the second recess boundary deforming elements 1464. In the eleventh slot aspect recess cross-section 1462, the second recess boundary deforming elements 1464 can have capabilities of varying their vertical positions either independently, or in coordinated groupings and can thereby provide a more finely detailed degree of recess cross-section control than is available for the tenth slot aspect recess cross-section 1456. The resiliently deformable boundary 1458 can be constructed with a natural undeformed position that affords a maximum recess cross-sectional area so that the dispositions of the second recess boundary deforming elements 1464, by their relative vertical positions, determine the operative disposition of the resiliently deformable boundary 1458. Alternatively, the resiliently deformable boundary 1458 can be interconnected with the second recess boundary deforming elements 1464 so that their upward and downward movement will also move the portion of the resiliently deformable boundary 1458 that is interconnected with those second recess boundary deforming elements 1464 that are moving. A still further alternative variant of the eleventh eighth slot aspect recess cross-section 1462 comprises alternative variants (not shown) of the second recess boundary deforming elements 1464, including variants wherein the second recess boundary deforming elements 1464 are shaped differently than the oval shape depicted in FIG. 14K, wherein the variants of the second recess boundary deforming elements 1464 are capable of altering their shape or size, such as by inflation, and variants wherein the second recess boundary deforming elements 1464 are caused to move (including horizontally, vertically, or diagonally) by a variety of means. These means encompass various mechanical and/or electrical mechanisms, and can be actuated by mechanical, electromagnetic, pneumatic, hydraulic, and other well understood manners of generating actuating forces.

Figure 14L:
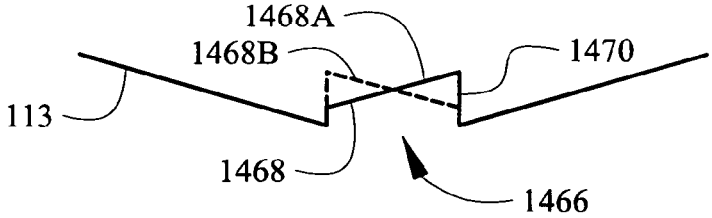

A twelfth slot aspect recess cross-section 1466 depicted in FIG. 14L involves a centrally pivoting slot aspect recess upper boundary element 1468 that is capable of pivoting between end positions 1468A and 1468B. The centrally pivoting slot aspect recess upper boundary element 1468 pivoting is capable of providing an enhanced degree of turning and/or roll control, among other capabilities, both by providing greater keel-plate-like effects and by operatively assuming a laterally asymmetrical profile (such as when in the end position 1468A) that is adapted for providing the vessel with this greater keel-plate-like effect in a manner that is responsive to the turn being effected. When the centrally pivoting slot aspect recess upper boundary element 1468 is in end position 1468A, the slot aspect recess presents a significantly greater depth on its right side than on its left side, which is useful when the vessel is effecting a right turn because the vessel's centripetal acceleration will tend to push the vessel to the left and hence the water surface will tend to cross the slot aspect recess in a left to right direction. The greater right side depth of the slot aspect recess when the centrally pivoting slot aspect recess upper boundary element 1468 is in position 1468A will present greater resistance to this left to right motion of the water, and hence will provide the vessel greater "traction" on the water to effect the turn and thereby produce the greater keel-plate-like effect. Controlling and actuating the pivoting of the centrally pivoting slot aspect recess upper boundary element 1468 (in addition to the previously described means of controlling and/or effecting movement of a portion of a slot aspect) can be configured to be inherently responsive to the vessel's motion itself, and changes thereof. An example of an inherently responsive means (not shown) can involve an inertial mass (such as spring-loaded counterweight) capable of responding to centripetal acceleration caused by turning the vessel at speed. The inertial mass would then move in response to the centripetal acceleration, and in so doing would actuate the pivoting of the centrally pivoting slot aspect recess upper boundary element 1468. Such an apparatus could operate, when the vessel is making the right turn described above, by said inertial mass sliding to the left in response to the vessel's centripetal acceleration, said leftward inertial mass motion pressing on a device such as a mechanical linkage or a compressible bladder to impel the centrally pivoting slot aspect recess upper boundary element 1468 into end position 1468A. Even an apparatus as simple as a weight sliding laterally on a track laying on top of the centrally pivoting slot aspect recess upper boundary element 1468 and running transverse to the longitudinal axis of the vessel can cause the shifting between the end positions 1468A and 1468B. The uneven weight distribution, engendered by the weight being impelled towards an end of the lateral track during a turn, causes the more heavily weighted side of the centrally pivoting slot aspect recess upper boundary element 1468 to pivot downwards thereby effecting the desired laterally asymmetrical slot aspect recess cross-section in automatic response to the vessel's turning action. A still more basic spring-loaded alternative embodiment (not shown) of the twelfth slot aspect recess cross-section 1466 is capable of having its slot aspect recess cross-section automatically altered by forces inherently involved in turning the vessel by responding to a lateral asymmetry in the surface pressure within the slot aspect recess during a turn. In a right turn, for example, the vessel's centripetal acceleration will impel the vessel to the left, and hence cause the right side of the slot aspect recess to be subject to a greater surface pressure than the left side is subject to. At least one spring (or other types of forcibly compressible rebounding members such as an elastic bladder of gas) is selected to provide an appropriate level of resistance to upward movement of either side of the centrally pivoting slot aspect recess upper boundary element 1468. The springs are utilized so that when the vessel is traveling relatively straight the centrally pivoting slot aspect recess upper boundary element 1468 is held relatively horizontal, and when the vessel is executing a sufficiently forceful turn the lateral pressure imbalance within the slot aspect recess will pivot upward the interior turn side of the centrally pivoting slot aspect recess upper boundary element 1468 and hence provide a higher slot aspect recess right side 1470 which will thereby facilitate the vessel's turning performance.

Figure 14M:
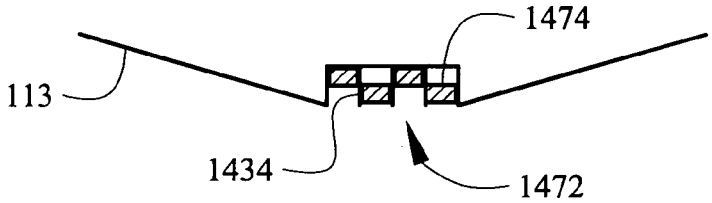
Figure 14N:
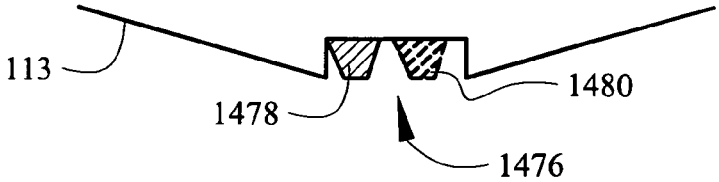

A thirteenth slot aspect recess cross-section 1472 depicted in FIG. 14M combines certain capabilities of the fifth slot aspect recess cross-section 1432 and certain capabilities of the sixth slot aspect recess cross-section 1436. The thirteenth slot aspect recess cross-section 1472 utilizes the slot aspect recess partitions 1434 to provide lateral subdivisions of the slot aspect recess, and disposes a plurality of third slot aspect recess movable elements 1474 (similar to laterally smaller versions of the second slot aspect recess movable element 1448) within the spaces between the slot aspect recess partitions 1434. The third slot aspect recess movable elements 1474 retain both the vertical movement capabilities of the second slot aspect recess moveable elements 1448 and the capabilities of moving independently of and/or in coordination with each other. A fourteenth slot aspect recess cross-section 1476 depicted in FIG. 14N provides capabilities of effecting additional manners of slot aspect recess cross-section alterations. A laterally movable slot aspect recess element 1478 has capacities of being disposed in various positions between, and including, the leftmost and rightmost positions within the slot aspect recess. While shown as a trapezoidal shaped cross-section, the laterally movable slot aspect recess element 1478, can also be constructed of differing shapes, as well as being capable of altering its shape in various well known manners. The fourteenth slot aspect recess cross-section 1476 is shown with a single laterally movable slot aspect recess element 1478 only for purposes of clarity of illustration and alternative variants of the fourteenth slot aspect recess cross-section 1476 (not shown) are capable of including a plurality of the laterally movable slot aspect recess elements 1478, at least some of which can also be capable of altering their shape. The various manners of controlling and/or effecting movement described previously in regard to other movable constituents of the present invention also apply to the constituents of the thirteenth slot aspect recess cross-section 1472 and the fourteenth slot aspect recess cross-section 1476 as well also.

The above described panoply of slot aspect recess cross-sections and elements thereof are also capable of being combined and/or intermixed in varied permutations to comprise alternative embodiments (not shown) of the present invention. Additionally, due to the interrelated associations between the topographic features and the slot aspects in a number of embodiments, many of the range of slot aspect recess cross-sections as well as the elements thereof are also capable of comprising attributes of the topographic features of alternative embodiments (not shown) of the slot-V hull system. Included among the types of interrelated associations are those wherein at least one of the topographic features and at least one of the slot aspects that comprise an embodiment are continuously intermeshed without an absolutely distinct demarcation between them. Such a case is exemplary of, but not a requirement for, an extension of the varieties of realizing a slot aspect recess cross-section to manners of realizing, operating, or designing topographic features of alternative embodiments of the present invention. In general, when a distinction between the nature of a topographic feature and a slot aspect is germane, they can usually be distinguished by their differing manners of optimal operation. Topographic features usually dispose at least a portion of their extent primarily out of the water and interacting primarily with a gas that is capable of being utilized for ventilation of a portion of the underside of a marine vessel hull. By contrast, at least one significant portion of at least one slot aspect is usually disposed so as to primarily interact with the water and/or a water/gas "spray" mixture. When functioning as intended, slot aspects are generally not primarily interacting with only a gas.

The slot-V hull system is comprised of a range of both methods and apparatuses which are capable of providing the functional capacities described herein. Regularly, these methods are characterizable in at least one of three ways:

1) As a method of providing a described apparatus for various functional uses;
2) As a method of operating a described apparatus for various purposes; and
3) As a method of performing various functions, in and of themselves, that are analogous to differing groups of functions that certain of the apparatuses described herein are also capable of performing when said apparatuses are operating.

These methods are often well described by the claim(s) that define them. The detailed means of implementation, if not entirely evident on the basis of a particular method claim or group of method claims, is evident when the claim is read in light of an apparatus described herein that is capable of providing, operating as, or performing the specific method claimed.

In view of the above, it will be seen that the various objects and features of the invention are achieved and other advantageous results obtained. The examples contained herein are merely illustrative and are not intended in a limiting sense.

What is claimed is:

1. A hull arrangement for a surface riding marine vessel comprising:

a marine vessel hull having an exterior surface, said hull including at least one fore hull portion and at least one aft hull portion;

at least one of said fore hull portions having a generally V-shaped overall exterior surface topography and at least one of said aft hull portions having a generally slot-V exterior surface topography, said fore hull portion V-shaped overall exterior surface topography extending across a substantial majority of said vessel's beam and said aft hull portion slot-V exterior surface topography approximating a V-shape modified by a slot aspect formed into said aft hull portion's underside, said slot aspect including a longitudinally extending, downwardly opening recess, wherein said recess is substantially disposed within a longitudinally extending slot recess region, said slot recess region substantially spreading about one sixth of the vessel's beam in a vertical direction and one quarter of the vessel's beam in a transverse direction, said slot recess region also generally disposed along a longitudinally centered contour of the hull's underside, and said recess is essentially devoid of any interrupting element so as to provide uninterrupted free flow of fluid through the recess;

said hull exterior surface including at least one topographic feature that at least partially extends appreciably forward of the slot aspect of the aft hull portion, said topographic feature facilitating ventilation of the slot aspect recess, when the marine vessel is in forward motion through the atmosphere, by aerodynamically influencing a part of the atmosphere to provide a ventilating airflow that accesses the region of the slot aspect.

2. The hull arrangement for a surface riding marine vessel according to claim 1 wherein said hull and topographic feature exerts said influencing while said ventilating airflow remains exterior of said marine vessel and hull.

3. The hull arrangement for a surface riding marine vessel according to claim 1 wherein said topographic feature is comprised of an area of the hull exterior surface that is continuously connected and devoid of aerodynamically significant openings.

4. The hull arrangement for a surface riding marine vessel according to claim 1, further comprising at least one step substantially disposed aft of a longitudinal midway point of said fore hull portion and ahead of a longitudinal midway point of said aft hull portion, said step extending below a waterline of said marine vessel.

5. The hull arrangement for a surface riding marine vessel according to claim 4, wherein said hull and step arrangement's disposition is characterizable by an attribute selected from a group consisting of:

a) said step is disposed proximate an aft end of said fore hull portion;

b) said step is disposed proximate a fore end of said aft hull portion;

c) said step establishes a transitional region between said fore hull portion and said aft hull portion;

d) said step demarcates the vicinity of a forward boundary of said slot aspect;

e) said hull and step arrangement producing a region of lower pressure behind said step when the marine vessel is in forward motion, said lower pressure region facilitating the ventilating airflow's accessing the region of the slot aspect;

f) and combinations thereof.

6. The hull arrangement for a surface riding marine vessel according to claim 1, further comprising at least a first and a second step, said first step disposed aft of said second step, said hull including an intermediate hull portion generally disposed between said first and second steps, said second step demarcating the general vicinity of an aft end of said fore hull portion, and said first step demarcating the general vicinity of a fore end of the aft hull portion, wherein said slot aspect is disposed aft of said first step.

7. The hull arrangement for a surface riding marine vessel according to claim 1, wherein said marine vessel hull has a net overall exterior surface shape, said net overall exterior surface approximating a general V-shape throughout at least a sizable majority of said vessel's longitudinal extent.

8. The hull arrangement for a surface riding marine vessel according to claim 7, wherein a dead rise angle of said net overall exterior surface general V-shape is variable along said vessel's longitudinal extent.

9. The hull arrangement for a surface riding marine vessel according to claim 1, said hull arrangement further including at least one slot aspect appendage, at least a portion of said slot aspect appendage capable of being disposed rearward of a transom of said vessel, said slot aspect appendage providing a slot aspect extension, said slot aspect extension being capable of effectively extending a rearwardmost reach of said slot aspect recess, wherein said slot aspect recess' extended rearwardmost reach is disposed farther rearward than said transom.

10. A hull arrangement for a surface riding marine vessel according to claim 9, wherein said slot aspect appendage is capable of selectively providing said effective extending of said slot aspect recess' rearwardmost reach.

11. A hull arrangement for a surface riding marine vessel according to claim 9, wherein at least one portion of said extended reach of said slot aspect recess is delineated by at least a first quality of said slot aspect extension, said first slot aspect extension delineating quality being capable of assuming at least two dispositions.

12. A hull arrangement for a surface riding marine vessel according to claim 11, wherein said first slot aspect extension delineating quality is capable of switching from at least a first of said first slot aspect extension delineating quality dispositions to at least a second of said first slot aspect extension delineating quality dispositions when said vessel is capable of operation.

13. A hull arrangement for a surface riding marine vessel according to claim 1, wherein at least a first portion of said slot aspect recess is delineated by at least a first quality of said slot aspect, said first slot aspect delineating quality being capable of assuming at least a first and a second disposition.

14. A hull arrangement for a surface riding marine vessel according to claim 13, wherein said first slot aspect delineating quality is capable of switching from at least a first of said first slot aspect delineating quality dispositions to at least a second of said first slot aspect delineating quality dispositions when said vessel is capable of operation.

15. A hull arrangement for a surface riding marine vessel according to claim 13, wherein said first and second dispositions of the first slot aspect delineating quality are capable of providing said first portion of the slot aspect recess with differing operative effects.

16. A hull arrangement for a surface riding marine vessel comprising:

a marine vessel hull, said hull having an exterior surface and including at least one forward hull portion and at least one rearward hull portion, said rearward hull portion being disposed aft of said forward hull portion, said hull exterior surface including at least one slot aspect;

at least one of said forward hull portions having a primarily V-shaped overall exterior surface configuration extending across a substantial majority of said vessel's beam and at least one of said rearward hull portions having a planing-facilitating exterior surface area, said slot aspect forming a net longitudinally extending, downwardly opening recess in an underside of the hull exterior surface, at least a portion of said slot aspect being disposed in the general vicinity of said planing-facilitating exterior surface area;

said slot aspect recess having dimensions of recess length, recess width, and recess depth, wherein a distance traveled along said recess length dimension corresponds to a length of path traversed when following said slot aspect recess, progress along a substantial portion of said recess length path providing a net longitudinal translation, and portions of said recess path length are characterizable as at least one of linear and curvilinear, said recess width dimension oriented parallel to the hull exterior surface and transverse to said recess length path, and said recess depth dimension oriented normal to the hull exterior surface;

wherein said slot aspect recess is disposed within a longitudinally extending central expanse with a width of a minor fraction of the vessel's beam, and said slot aspect recess is essentially devoid of any interrupting element so as to provide uninterrupted free flow of fluid through the substantial majority of said slot aspect recess' cross-section; and wherein said hull exterior surface includes at least one topographic feature that at least partially extends appreciably forward of the slot aspect of the rearward hull portion, said topographic feature facilitating ventilation of the slot aspect recess, when the marine vessel is in forward motion through the atmosphere, by aerodynamically influencing a part of the atmosphere to provide a ventilating airflow that accesses the region of the slot aspect.

17. A hull arrangement for a surface riding marine vessel according to claim 16, wherein said slot aspect extends longitudinally forward of said planing-facilitating exterior surface area and said slot aspect's forwardmost extent is less far forward than a forwardmost point of said hull.

18. A hull arrangement for a surface riding marine vessel according to claim 16, wherein said hull arrangement includes at least one step.

19. A hull arrangement for a surface riding marine vessel according to claim 16, wherein said forward hull portions having a primarily V-shaped overall exterior surface configuration that extends substantially across a beam of said vessel.

20. A hull arrangement for a surface riding marine vessel according to claim 16, wherein at least one said slot aspect recess is substantially arranged in a longitudinally central disposition.

21. The hull arrangement for a surface riding marine vessel according to claim 16, wherein said marine vessel hull has a predominant overall exterior surface shape, said predominant overall exterior surface approximating a general V-shape throughout at least a sizable majority of said vessel's longitudinal extent.

22. The hull arrangement for a surface riding marine vessel according to claim 21, wherein a dead rise angle of said predominant overall exterior surface general V-shape is variable along said vessel's longitudinal extent.

23. A hull arrangement for a surface riding marine vessel according to claim 16, said hull arrangement further including at least one slot aspect appendage, at least a portion of said slot aspect appendage capable of being disposed rearward of a transom of said vessel, said slot aspect appendage providing a slot aspect extension, said slot aspect extension being capable of effectively extending a rearwardmost reach of said slot aspect recess, wherein said slot aspect recess' extended rearwardmost reach is disposed farther rearward than said transom.

24. A hull arrangement for a surface riding marine vessel according to claim 23 wherein said slot aspect appendage is capable of selectively providing said effective extending of said slot aspect recess' rearwardmost reach.

25. A hull arrangement for a surface riding marine vessel according to claim 23 wherein said slot aspect appendage has a detachable capability.

26. A hull arrangement for a surface riding marine vessel according to claim 23, wherein at least a first portion of said extended reach of the slot aspect recess is delineated by at least a first quality of said slot aspect extension, said first slot aspect extension delineating quality being capable of assuming a plurality of dispositions.

27. A hull arrangement for a surface riding marine vessel according to claim 26, wherein at least a first and a second of said first slot aspect extension delineating quality dispositions are capable of providing said first portion of said extended reach of the slot aspect recess with differing operative effects.

28. A hull arrangement for a surface riding marine vessel according to claim 26, wherein said first slot aspect extension delineating quality is capable of switching from at least one of said first and second slot aspect extension delineating quality dispositions to at least another of said first and second slot aspect extension delineating quality dispositions when said vessel is capable of operation.

29. A hull arrangement for a surface riding marine vessel according to claim 16, wherein at least a first portion of said slot aspect recess is delineated by at least a first quality of said slot aspect, said first slot aspect delineating quality being capable of assuming a plurality of dispositions.

30. A hull arrangement for a surface riding marine vessel according to claim 29, wherein said first slot aspect delineating quality is capable of switching from at least a first of said first slot aspect delineating quality dispositions to at least a second of said first slot aspect delineating quality dispositions when said vessel is capable of operation.

31. A hull arrangement for a surface riding marine vessel according to claim 29, wherein at least a first and a second of said first slot aspect delineating quality dispositions are capable of providing said first portion of the slot aspect recess with differing operative effects.

32. A hull arrangement for a surface riding marine vessel according to claim 29, wherein at least a second portion of said slot aspect recess is delineated by at least a second quality of said slot aspect, said second slot aspect delineating quality being capable of assuming a plurality of dispositions.

33. A hull arrangement for a surface riding marine vessel according to claim 32, wherein at least a first and a second of said second slot aspect delineating quality dispositions are capable of providing said second portion of the slot aspect recess with differing operative effects.

34. A hull arrangement for a surface riding marine vessel according to claim 32, wherein said second slot aspect delineating quality is capable of switching from at least one of said second slot aspect delineating quality dispositions to at least another of said second slot aspect delineating quality dispositions when said vessel is capable of operation.

35. A method of providing operating capabilities for a marine vessel by arranging characteristics of a hull of said vessel comprising the steps of:

Organizing a marine vessel hull having an exterior surface into at least one fore hull portion and at least one aft hull portion;

Arranging at least one fore hull portion in a generally V-shaped exterior surface configuration and at least one aft hull portion in a generally slot-V shaped exterior surface configuration, said fore hull portion V-shaped exterior surface configuration extending across a substantial majority of said vessel's beam;

Arranging at least one aft hull portion in a generally slot-V exterior surface topography approximating an overall V-shape modified by a slot aspect formed into said aft hull portion's underside, said slot aspect including a longitudinally extending, downwardly opening recess, said recess being substantially disposed within a longitudinally extending slot recess region, said slot recess region substantially spreading about one sixth of the vessel's beam in a vertical direction and one quarter of the vessel's beam in a transverse direction, said slot recess region also generally disposed along a longitudinally centered contour of the hull's underside, and said recess being essentially devoid of any interrupting element so as to provide uninterrupted free flow of fluid through the recess;

Arranging at least one topographic feature of an exterior surface of said hull arrangement so that said topographic feature at least partially extends appreciably forward of said slot aspect;

Facilitating ventilation of said slot aspect by also arranging said topographic feature in a disposition that, when the vessel is in forward motion, aerodynamically influences a part of the atmosphere to provide a ventilating airflow that accesses the region of the slot aspect.

36. The method of providing operating capabilities for a marine vessel by arranging characteristics of a hull of said vessel according to claim 35, wherein said overall V-shapes of said fore hull and said aft hull portions are capable of having dead rise angles that is variable along said vessel's longitudinal extent, both within either of said fore hull and aft hull portions, as well as between said fore hull and aft hull portions.

37. The method of providing operating capabilities for a marine vessel by arranging characteristics of a hull of said vessel according to claim 35, further comprising the step of providing a slot-V hull system capable of enabling realization of said claim 35 method.

38. The method of providing operating capabilities for a marine vessel by arranging characteristics of a hull of said vessel according to claim 35, further comprising the step of including at least one slot aspect appendage, at least a portion of said slot aspect appendage capable of being disposed rearward of a transom of said vessel, said slot aspect appendage providing a slot aspect extension, said slot aspect extension being capable of effectively extending a rearwardmost reach of said slot aspect recess, wherein said slot aspect recess' extended rearwardmost reach is disposed farther rearward than said transom.

39. The method of providing operating capabilities for a marine vessel by arranging characteristics of a hull of said vessel according to claim 38, wherein said slot aspect appendage is capable of providing said effective extending of said slot aspect recess' rearwardmost reach selectively.

40. The method of providing operating capabilities for a marine vessel by arranging characteristics of a hull of said vessel according to claim 38, wherein at least one portion of said extended reach of said slot aspect recess is delineated by at least a first quality of said slot aspect extension, said first slot aspect extension delineating quality being capable of assuming at least two dispositions.

41. The method of providing operating capabilities for a marine vessel by arranging characteristics of a hull of said vessel according to claim 40, wherein said first slot aspect extension delineating quality is capable of switching from at least a first of said first slot aspect extension delineating quality dispositions to at least a second of said first slot aspect extension delineating quality dispositions when said vessel is capable of operation.

42. The method of providing operating capabilities for a marine vessel by arranging characteristics of a hull of said vessel according to claim 35, wherein at least a first portion of said slot aspect recess is delineated by at least a first quality of said slot aspect, said first slot aspect delineating quality being capable of assuming at least a first and a second disposition.

43. The method of providing operating capabilities for a marine vessel by arranging characteristics of a hull of said vessel according to claim 42, wherein said first slot aspect delineating quality is capable of switching from at least a first of said first slot aspect delineating quality dispositions to at least a second of said first slot aspect delineating quality dispositions when said vessel is capable of operation.

44. The method of providing operating capabilities for a marine vessel by arranging characteristics of a hull of said vessel according to claim 42, wherein said first and second dispositions of the first slot aspect delineating quality are capable of providing said first portion of the slot aspect recess with differing operative effects.

45. A method of managing hydrodynamic and aerodynamic factors that are capable of affecting a surface riding marine vessel's operation comprising the steps of:

Traversing a surface of a body of water with a marine vessel having a hull, said hull having an exterior surface;

Managing at least one hydrodynamic factor capable of affecting said vessel by interacting with the water producing said hydrodynamic factor with at least one leading portion of said hull, said leading hull portion's exterior surface primarily arranged in an aggregate V-shape extending across a substantial majority of said vessel's beam;

Establishing said marine vessel, when at sufficient forward speed, in a planing attitude by supporting an adequate portion of said marine vessel on at least one planing hull portion of said hull exterior surface at a pitch suitable for said marine vessel to be capable of planing; and Facilitating establishing said marine vessel in a planing attitude by employing at least one slot aspect of said hull;

said slot aspect comprising a net longitudinally extending, downwardly opening slot aspect recess in at least one portion of an underside of the hull exterior surface, said slot aspect recess being both essentially devoid of any interrupting element so as to provide uninterrupted free flow of fluid through said slot aspect recess and disposed within a longitudinally extending central expanse whose width is a minor fraction of the vessel's beam, said slot aspect recess having dimensions of recess length, recess width, and recess depth;

said recess length dimension being said slot aspect recess' greatest dimensional extent, a slot aspect recess principal path along said recess length dimension having portions that are characterizable as at least one of linear and curvilinear, and progress along a substantial portion of said recess length principal path providing a net longitudinal translation;

said recess width dimension being oriented parallel to said hull exterior surface and transverse to said recess length dimension;

said recess depth dimension being oriented normal to said hull's overall exterior surface;

at least one of said recess width dimension and recess depth dimension having a maximum magnitude no greater than a substantially minor fraction of said vessel's beam;

wherein said facilitating involves utilizing at least one of said slot aspect recess and said planing hull portion to manage aerodynamic and hydrodynamic factors that are capable of affecting said vessel's establishing of a planing attitude; wherein said hull exterior surface includes at least one topographic feature that at least partially extends appreciably forward of the slot aspect, said topographic feature facilitating ventilation of the slot aspect recess, when the marine vessel is in forward motion through the atmosphere, by aerodynamically influencing a part of the atmosphere to provide a ventilating airflow that accesses the region of said slot aspect.

46. The method of managing hydrodynamic and aerodynamic factors that are capable of affecting a surface riding marine vessel's operation according to claim 45, further comprising the step of providing a hull system capable of realizing said claim 45 method of managing hydrodynamic and aerodynamic factors.

47. The method of managing hydrodynamic and aerodynamic factors that are capable of affecting a surface riding marine vessel's operation according to claim 45, wherein said hull includes at least one step.

48. The method of managing hydrodynamic and aerodynamic factors that are capable of affecting a surface riding marine vessel's operation according to claim 45, wherein said marine vessel hull has a net overall exterior surface shape, said net overall exterior surface approximating a general V-shape throughout at least a sizable majority of said vessel's longitudinal extent.

49. The method of managing hydrodynamic and aerodynamic factors that are capable of affecting a surface riding marine vessel's operation according to claim 48, wherein a dead rise angle of said net overall exterior surface general V-shape is variable along said vessel's longitudinal extent.

50. The method of managing hydrodynamic and aerodynamic factors that are capable of affecting a surface riding marine vessel's operation according to claim 45, wherein said step of facilitating establishing said marine vessel in a planing attitude further includes capabilities of employing at least one slot aspect appendage;

at least a portion of said slot aspect appendage being capable of being disposed rearward of a transom of said vessel, said slot aspect appendage providing a slot aspect extension, said slot aspect extension being capable of effectively extending a rearwardmost reach of said slot aspect recess, wherein said slot aspect recess' extended rearwardmost reach is disposed farther rearward than said transom.

51. The method of managing hydrodynamic and aerodynamic factors that are capable of affecting a surface riding marine vessel's operation according to claim 50, wherein said slot aspect appendage is capable of providing said effective extending of said slot aspect recess' rearwardmost reach selectively.

52. The method of managing hydrodynamic and aerodynamic factors that are capable of affecting a surface riding marine vessel's operation according to claim 50, wherein at least a first portion of said extended reach of the slot aspect recess is delineated by at least a first quality of said slot aspect extension, said first slot aspect extension delineating quality being capable of assuming a plurality of dispositions.

53. The method of managing hydrodynamic and aerodynamic factors that are capable of affecting a surface riding marine vessel's operation according to claim 52, wherein at least a first and a second of said first slot aspect extension delineating quality dispositions are capable of providing said first portion of said extended reach of the slot aspect recess with differing operative effects.

54. The method of managing hydrodynamic and aerodynamic factors that are capable of affecting a surface riding marine vessel's operation according to claim 52, wherein said first slot aspect extension delineating quality is capable of switching from at least one of said first and second slot aspect extension delineating quality dispositions to at least another of said first and second slot aspect extension delineating quality dispositions when said vessel is capable of operation.

55. The method of managing hydrodynamic and aerodynamic factors that are capable of affecting a surface riding marine vessel's operation according to claim 45, wherein at least a first portion of said slot aspect recess is delineated by at least a first quality of said slot aspect, said first slot aspect delineating quality being capable of assuming a plurality of dispositions.

56. The method of managing hydrodynamic and aerodynamic factors that are capable of affecting a surface riding marine vessel's operation according to claim 55, wherein said first slot aspect delineating quality is capable of switching from at least a first of said first slot aspect delineating quality dispositions to at least a second of said first slot aspect delineating quality dispositions when said vessel is capable of operation.

57. The method of managing hydrodynamic and aerodynamic factors that are capable of affecting a surface riding marine vessel's operation according to claim 55, wherein at least a first and a second of said first slot aspect delineating quality dispositions are capable of providing said first portion of the slot aspect recess with differing operative effects.

58. The method of managing hydrodynamic and aerodynamic factors that are capable of affecting a surface riding marine vessel's operation according to claim 55, wherein at least a second portion of said slot aspect recess is delineated by at least a second quality of said slot aspect, said second slot aspect delineating quality being capable of assuming a plurality of dispositions.

59. The method of managing hydrodynamic and aerodynamic factors that are capable of affecting a surface riding marine vessel's operation according to claim 58, wherein at least a first and a second of said second slot aspect delineating quality dispositions are capable of providing said second portion of the slot aspect recess with differing operative effects.

60. The method of managing hydrodynamic and aerodynamic factors that are capable of affecting a surface riding marine vessel's operation according to claim 58, wherein said second slot aspect delineating quality is capable of switching from at least one of said second slot aspect delineating quality dispositions to at least another of said second slot aspect delineating quality dispositions when said vessel is capable of operation.

* * * * *